US012163763B2

(12) United States Patent
Dawson, Jr.

(10) Patent No.: US 12,163,763 B2
(45) Date of Patent: Dec. 10, 2024

(54) SIGHTING SYSTEMS, COMPONENTS, AND METHODS

(71) Applicant: David J. Dawson, Jr., Florence, TX (US)

(72) Inventor: David J. Dawson, Jr., Florence, TX (US)

( * ) Notice: Subject to any disclaimer, the term of this patent is extended or adjusted under 35 U.S.C. 154(b) by 0 days.

(21) Appl. No.: 17/958,628

(22) Filed: Oct. 3, 2022

(65) Prior Publication Data

US 2023/0228530 A1 Jul. 20, 2023

Related U.S. Application Data

(63) Continuation of application No. 17/189,052, filed on Mar. 1, 2021, now Pat. No. 11,460,274.

(60) Provisional application No. 62/983,986, filed on Mar. 2, 2020.

(51) Int. Cl.
*F41G 11/00* (2006.01)
*F41G 1/26* (2006.01)
*F41G 1/30* (2006.01)

(52) U.S. Cl.
CPC ..... *F41G 11/001* (2013.01); *F41G 1/26* (2013.01); *F41G 1/30* (2013.01)

(58) Field of Classification Search
CPC . F41G 11/001; F41G 1/26; F41G 1/30; F41G 1/16
See application file for complete search history.

(56) References Cited

U.S. PATENT DOCUMENTS

| | | | | |
|---|---|---|---|---|
| 4,200,989 | A * | 5/1980 | Brouthers | F41G 1/26 42/137 |
| 4,628,611 | A * | 12/1986 | Ruffino | F41G 1/16 42/137 |
| 7,610,712 | B2 | 11/2009 | Ertl | |
| 8,925,238 | B2 | 1/2015 | Anderson | |
| 9,696,114 | B1 * | 7/2017 | Cabrera | F41G 1/10 |
| 10,871,350 | B1 * | 12/2020 | Thomas | F41G 1/16 |
| 10,876,815 | B1 * | 12/2020 | Wingfield | F41G 1/16 |
| 11,002,517 | B1 * | 5/2021 | Holly | F41G 1/30 |
| 11,112,214 | B2 * | 9/2021 | Niswander | F41G 11/001 |
| 11,131,526 | B2 * | 9/2021 | Shawley | F41G 1/06 |

(Continued)

*Primary Examiner* — Joshua E Freeman
(74) *Attorney, Agent, or Firm* — Lauff Law PLLC

(57) ABSTRACT

Sight systems comprise a sight receiver and a base attachable to and detachable from a sight receiver. A base carries a sighting component, such as an iron sight or optic sight. A sighting component may be attachably and detachably mounted to a base, or a sighting component may be made integrally with a base. A base may carry plural sighting components. Sight systems may include plural interchangeable sight receivers, bases, and/or sighting components. In some embodiments, interfitting structures at least partially restrain or retain a base and a sight receiver in longitudinal and lateral alignment, with such structures being longitudinally oriented. In some embodiments, interfitting structures at least partially restrain or retain a base and a sighting component in longitudinal alignment and lateral alignment, with such structures being longitudinally oriented. Some embodiments provide a fastener operable with a compatible and/or complementary surface, together used to urge interfitting parts together tightly.

4 Claims, 22 Drawing Sheets

(56) References Cited

U.S. PATENT DOCUMENTS

| | | | | |
|---|---|---|---|---|
| 2010/0083554 | A1* | 4/2010 | Elpedes | F41G 1/30 42/130 |
| 2014/0230305 | A1* | 8/2014 | Zimmer | F41C 3/00 42/111 |
| 2014/0259856 | A1 | 9/2014 | Kruse | |
| 2015/0285590 | A1 | 10/2015 | Law | |
| 2016/0223291 | A1* | 8/2016 | Wolf | F41G 1/24 |
| 2017/0059277 | A1* | 3/2017 | Justice | F41G 11/003 |
| 2018/0087871 | A1* | 3/2018 | Toner | F41G 1/16 |
| 2018/0195835 | A1* | 7/2018 | Crispin | F41G 1/30 |
| 2019/0017781 | A1 | 1/2019 | Noonan | |
| 2019/0049217 | A1* | 2/2019 | Costet | F41G 1/16 |
| 2019/0257620 | A1* | 8/2019 | Zimmer | F41C 3/00 |
| 2019/0331461 | A1* | 10/2019 | Zimmer | F41G 1/17 |
| 2020/0025520 | A1* | 1/2020 | Niswander | F41G 11/003 |
| 2020/0326157 | A1* | 10/2020 | Curry | F41A 21/484 |
| 2021/0310767 | A1* | 10/2021 | Baker | G02B 26/0816 |
| 2021/0325146 | A1* | 10/2021 | Thomele | F41G 1/065 |
| 2023/0296352 | A1 | 9/2023 | Eaton | |

* cited by examiner

SIGHTING SYSTEMS, COMPONENTS, AND METHODS

CROSS REFERENCE TO RELATED APPLICATIONS

This application is a continuation of U.S. application Ser. No. 17/189,052 filed on Mar. 1, 2021. This application claims the benefit under 35 U.S.C. § 119(e) of U.S. Provisional Patent Application Ser. No. 62/983,986 filed Mar. 2, 2020, through copending U.S. application Ser. No. 17/189,052. Application Ser. No. 17/189,052 and application Ser. No. 62/983,986 are incorporated herein by reference.

BACKGROUND

Firearms, air guns, crossbows, and other projectile launching devices typically use sights to align the devices with the intended targets, i.e., the intended point of impact of the projectile. Sighting systems may be classified in various ways, for example into sight systems using only mechanical structures, sight systems using basic optics components, and sight systems using electronic components along with mechanical structures, optics components, or both. This disclosure will use the term "iron sights" to refer to sighting systems using only mechanical structures, and the term "optic sights" to refer to sighting systems using optics or electronics, or both.

Within the taxonomy used in this disclosure, the term "iron sight" comprises traditional open sights and aperture sights, as well as open sights and aperture sights further comprising enhancements such as optical fiber components, radioluminescent components, paint-marked components, and similar aides to perception not using electronics or optics. In addition to sights made of iron, the term "iron sight" also comprises sights comprising or composed of materials other than iron, for example aluminum, titanium, brass, polyester, nylon, PVC, and other metal, plastic, and similar materials.

Also within the taxonomy used in this closure, the term "optic sight" comprises telescopic sights, holographic sights, reflex sights, and similar devices. The term "optic sight" comprises devices having electrical powered light emission components, such as LEDs, as well as devices having passive light emission components, such as optical fiber or radio luminescent structures, or both.

A firearm, air gun, crossbow, and other projectile launching device also typically comprises a frame or receiver that provides a housing for internal action components such as a hammer, firing pin, extractor, trigger, and bolt or breechblock mechanism. Often, a barrel or other projectile directing component is mounted to the frame or receiver. In some configurations, such as many rifles, shotguns, and revolvers, the sighting system comprises a front sight mounted proximal to the muzzle and a rear sight mounted on the frame or receiver. In some configurations, such as many pistols, both front and rear sights are mounted on a slide that reciprocates when the pistol is fired. In some configurations, front or rear sight components, or both, are mounted on accessory rails or retainers, for example a Picatinny rail, a rail interface system, or a rail integration system. Regardless of any particular sight mounting system, the discussions in this disclosure will use the term "sight receiver" to refer to a component of a firearm, air gun, crossbow, or other projectile launching device, upon which a sight component is directly or indirectly mounted. As used in this disclosure, a sight receiver may be integrally formed in a firearm component, such as a frame, receiver, or slide, or may be a separate component attached to the projectile launching device, such as a Picatinny rail.

When used in this disclosure with respect to surfaces, edges, protrusions, recesses, or other geometries, unless clearly used differently the terms "compatible" and "complementary" mean that the items are configured to abut, fit together, or otherwise engage in a way that restrains relative translation or rotation, or both, in one or more directions, for example by having matching profiles mated together. As used in this disclosure, unless clearly used differently the term "interfitting parts" shall refer to plural structures having compatible or complementary surfaces, edges, protrusions, recesses, or other geometries.

When used in this disclosure with respect or reference to a projectile launching device, unless clearly used differently the term "longitudinal" is used to refer to a direction substantially in alignment with the direction in which a projectile is ejected from a projectile launching device when the device is activated, for example by pulling a trigger. In addition, when used in this disclosure with respect or reference to a projectile launching device, unless clearly used differently the term "lateral" is used to refer to a direction that substantially deviates from the longitudinal direction, for example substantially orthogonal to the longitudinal direction. Unless clearly used differently, the terms "up," "upper," "top," "vertical," "down," "lower," "bottom" and "horizontal" are used with reference to a sight system of a projectile launching device when the projectile launching device is oriented in the normal, most common position in which such device is operated by a person having ordinary or better skill using such device. For example, for a projectile launching device normally held at an angle to upright for operational use of a sight system, the terms "up," "upper," and "top" are oriented away from the projectile launching device, and the terms "down," "lower," and "bottom" are oriented toward the projectile launching device. An example would be an iron sight system mounted on a Picatinny rail of a rifle at on offset angle, with the rifle held at that angle to use the sights.

When used in this disclosure with respect to a structure or component, unless clearly used differently the correlative terms "attachable" and "detachable" indicate that such structure or component is capable of being attached or fastened to another structure or component, or correlatively detached or unfastened from another structure component, by use of fastening means such as screws, pins, detents, springs, pawls, clips, low-tack removable adhesives, compatible or complementary surfaces, and similar readily engageable and disengageable means, and the terms "fastening means" and "fasteners" shall be used in this disclosure to refer to any such items and any combination of such items. The terms "attaching" and "detaching" as used in this disclosure mean, respectively, attaching or fastening, and detaching or unfastening, structures or components that are "attachable" and "detachable." Structures and components that are integrally formed, or that are welded, bonded with high-tack permanent adhesives (such as cyanoacrylates and epoxies), or joined with similar difficult-to-disengage means, are not "attachable" or "detachable" as those terms are used in this disclosure. In this disclosure, the term "driving means" with respect to screws or other threaded fasteners means any of the various shaped cavities and protrusions on a screw head that allow torque to be applied to a screw, including but not limited to recesses having a slot, cross, Phillips, frearson, French recess, JIS B 1012, Mortorq, Pozidriv, Supadriv, torq-set, or combination phillips/slotted shape, and also recesses or protrusions having a square, pentagonal, hex, 12-point, tri-angle, Robertson, hex socket, security hex, double-square, triple-square, XZN, 12-spline flange, double hex, torx, T & TX, security torx, TR, torx plus, Polydrive, torx ttap, line head, line head, tri-point, tri-groove, tri-wing, clutch A, clutch G, one-way, Bristol, Quadrex, pentalobular, or spanner shape. Also, in this disclosure the term "screw head" means the end of a threaded fastener comprising the driving means, which may have various shapes, including but not limited to pan head, button or dome head, round head, mushroom or truss head, countersunk or flat head, oval or raised head, bugle head, cheese head, fillister head, socket head, and which may be configured with or without flanges or shoulders or both.

SUMMARY

Sight systems disclosed herein comprise a sight receiver and a base attachable to and detachable from a sight receiver. Various means of attaching a base to a sight receiver may be used, including one or more discrete fastening means, with or without the use of distributed interfitting parts.

A base carries a sighting component, such as an iron sight or optic sight. A sighting component may be attachably and detachably mounted to a base. Alternatively, a sighting component may be made integrally with or be permanently bonded to a base. For example, a portion of an optic sight or iron sight may be configured and function as a base. A base may carry plural sighting components. Sight systems may include plural sight receivers, bases, and/or sighting components, some or all of which may be interchangeable.

In some embodiments, interfitting structures form means to at least partially restrain or retain a base and a sight receiver in longitudinal alignment and lateral alignment when assembled together, with such structures being longitudinally oriented. In some embodiments, interfitting structures form means to at least partially restrain or retain a sighting component and a sight receiver in longitudinal alignment and lateral alignment when assembled together, with such structures being longitudinally oriented. Some embodiments provide a fastener operable with a compatible and/or complementary surface, together used as a means to urge interfitting parts together tightly.

DETAILED DESCRIPTION

For convenience of description, the embodiments described in this section of the disclosure are configured for use on a conventional pistol slide, but deployment of sighting systems may be similarly configured for other types of projectile launching devices and/or for use on other components of a projectile launching device, for example a frame, a receiver, or an accessory rail. FIGS. 1-8 depict an example of such a slide, and the following descriptions of slide elements and configurations, arrangements, and orientations of slide elements are made with respect to that example, even where not expressly addressed to that slide. Other embodiments of slides, receivers, frames, and/or rails may, and likely will, have differences in elements and configuration, arrangement, and/or orientation of elements yet still be within the scope of one or more of the claims.

Figure 1:
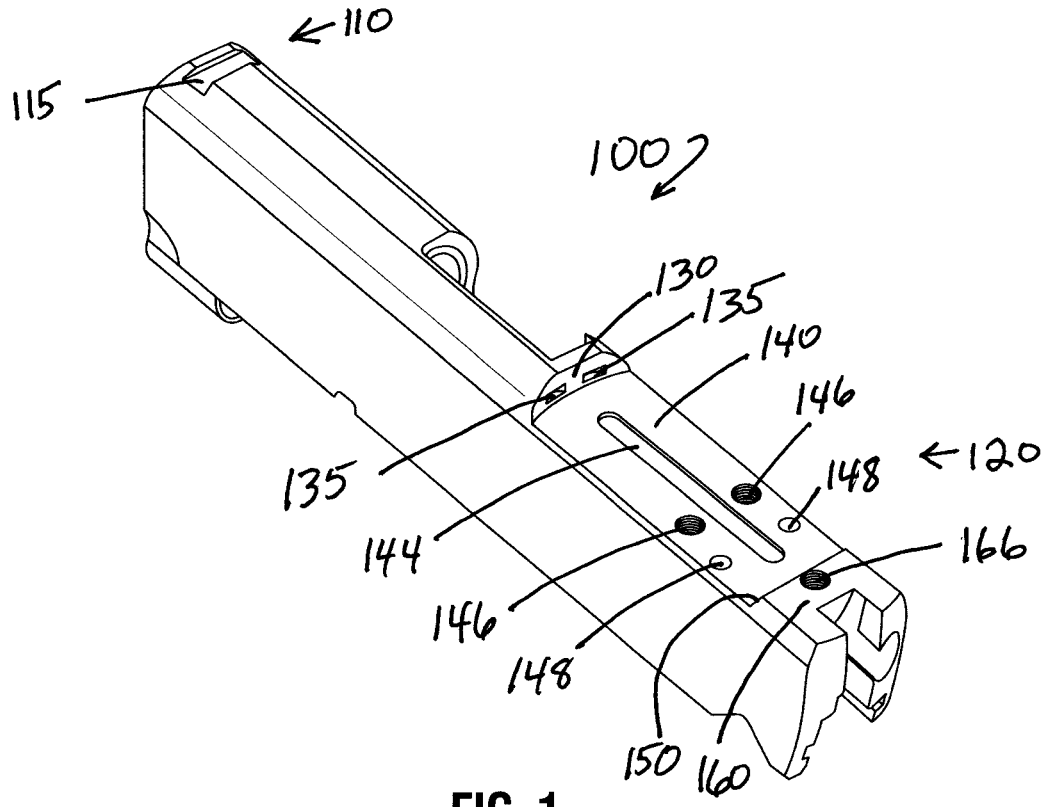
FIG. 1 is a perspective view of a slide for a projectile launching device in one embodiment.
Figure 2:
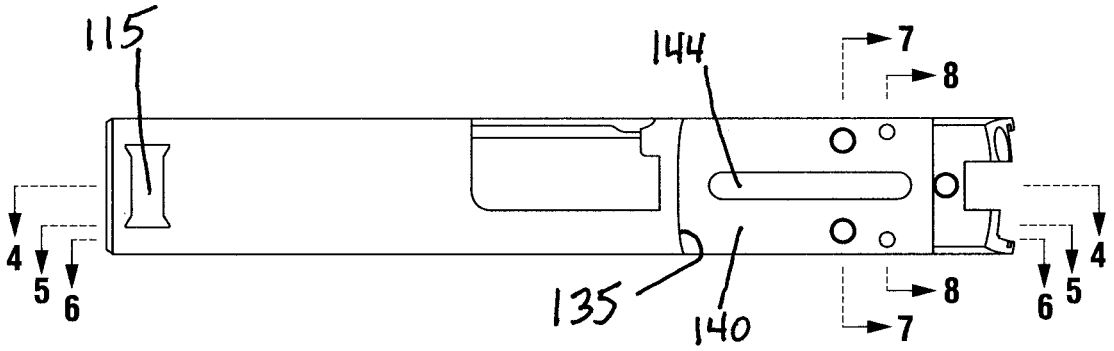
FIG. 2 is a plan view of the slide depicted in FIG. 1.
Figure 3:
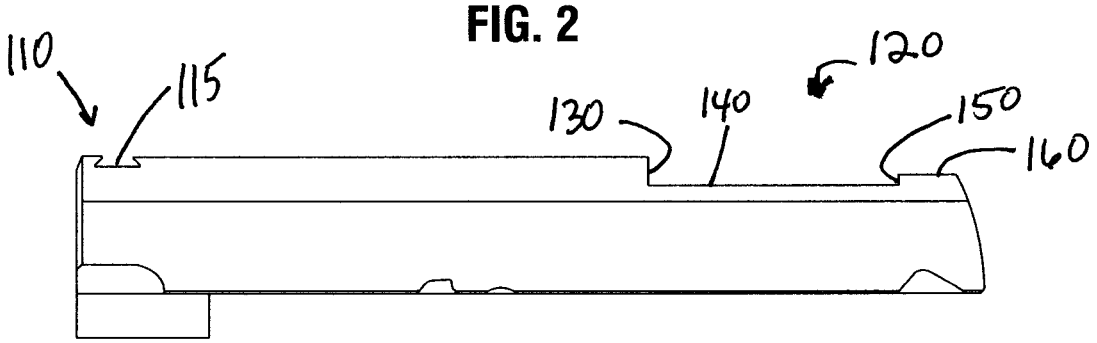
FIG. 3 is an elevation view of the slide depicted in FIG. 1.
Figure 4:
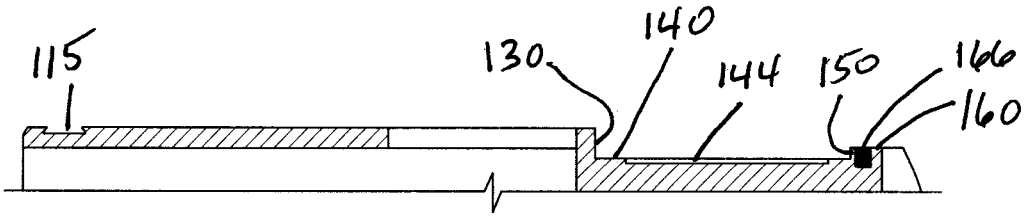
FIG. 4 is a section view of the slide depicted in FIG. 1 taken upon section plane 4-4 indicated on FIG. 2.
Figure 5:
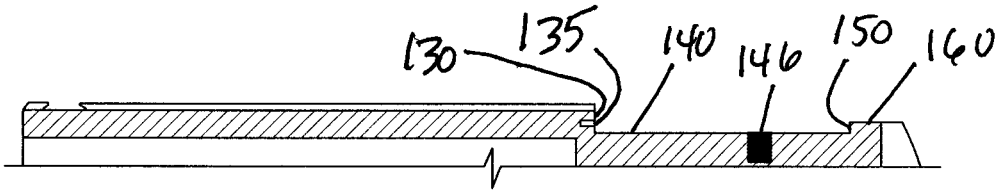
FIG. 5 is a section view of the slide depicted in FIG. 1 taken upon section plane 5-5 indicated on FIG. 2.
Figure 6:
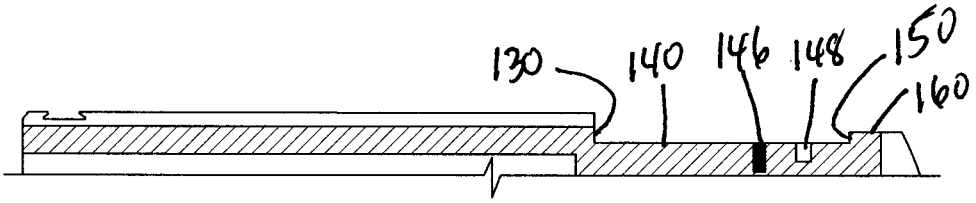
FIG. 6 is a section view of the slide depicted in FIG. 1 taken upon section plane 6-6 indicated on FIG. 2.
Figure 7:
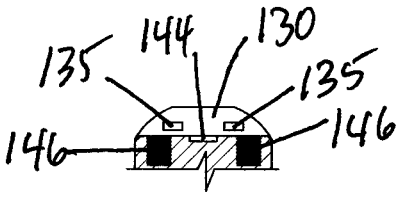
FIG. 7 is a section view of the slide depicted in FIG. 1 taken upon section plane 7-7 indicated on FIG. 2.
Figure 8:
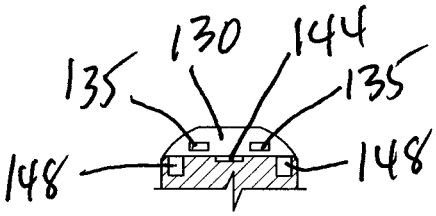
FIG. 8 is a section view of the slide depicted in FIG. 1 taken upon section plane 8-8 indicated on FIG. 2.
Figure 9:
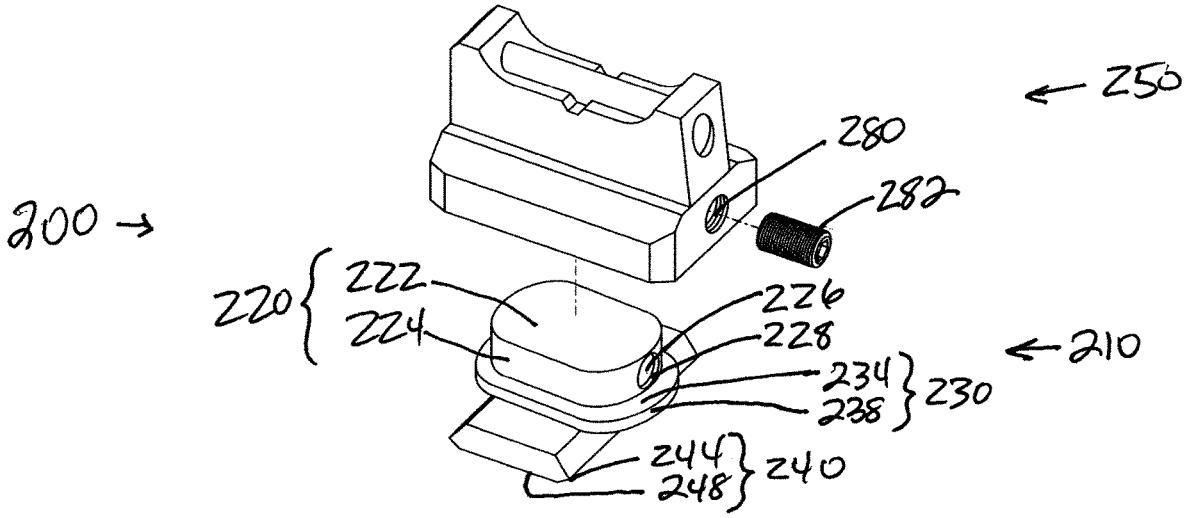
FIG. 9 is a perspective view of a base and sighting component in one embodiment.
Figure 10:
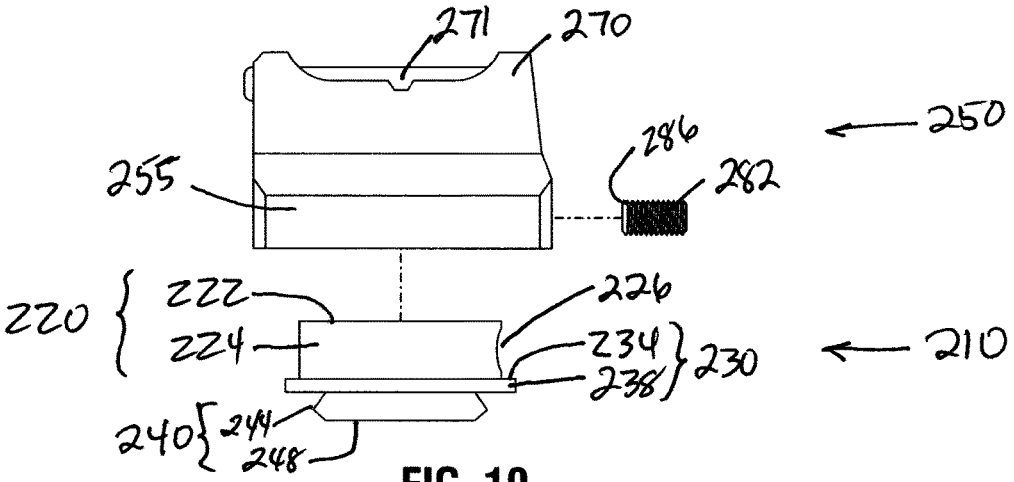
FIG. 10 is an elevation view of the base and sighting component depicted in FIG. 9.
Figure 11:
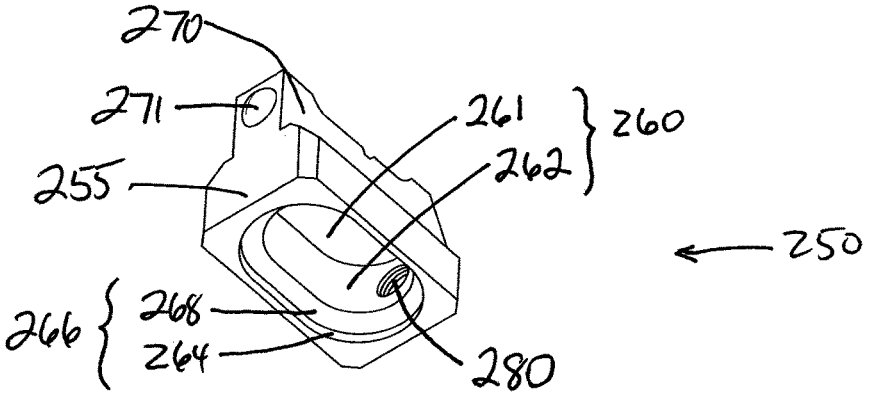
FIG. 11 is a perspective view of the base and sighting component depicted in FIG. 9.
Figure 12:
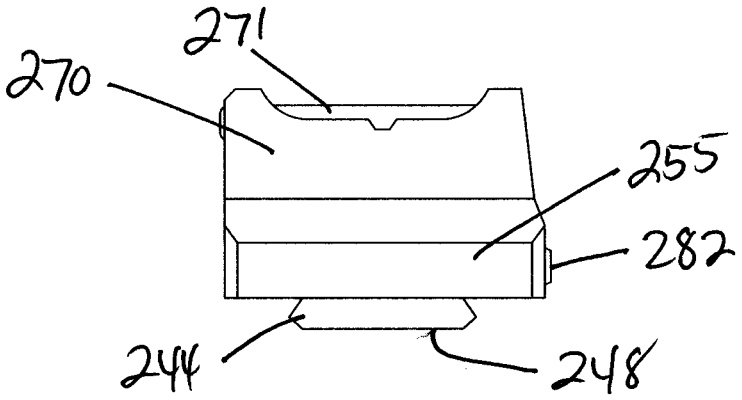
FIG. 12 is an elevation view of the base and sighting component depicted in FIG. 9.
Figure 13:
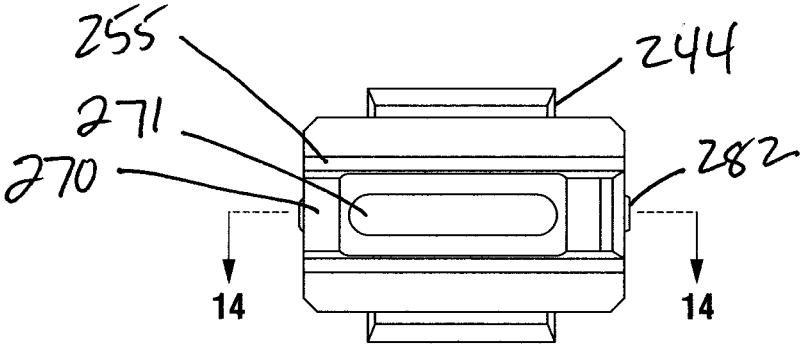
FIG. 13 is a plan view of the base and sighting component depicted in FIG. 9.
Figure 14:
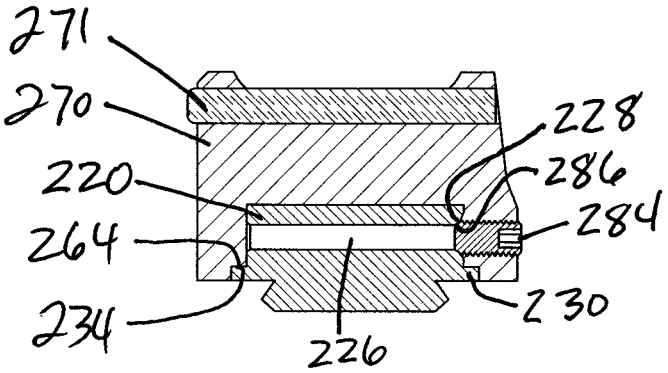
FIG. 14 is a section view of the base and sighting component depicted in FIG. 9 taken upon section plane 14-14 indicated on FIG. 13.
Figure 15:
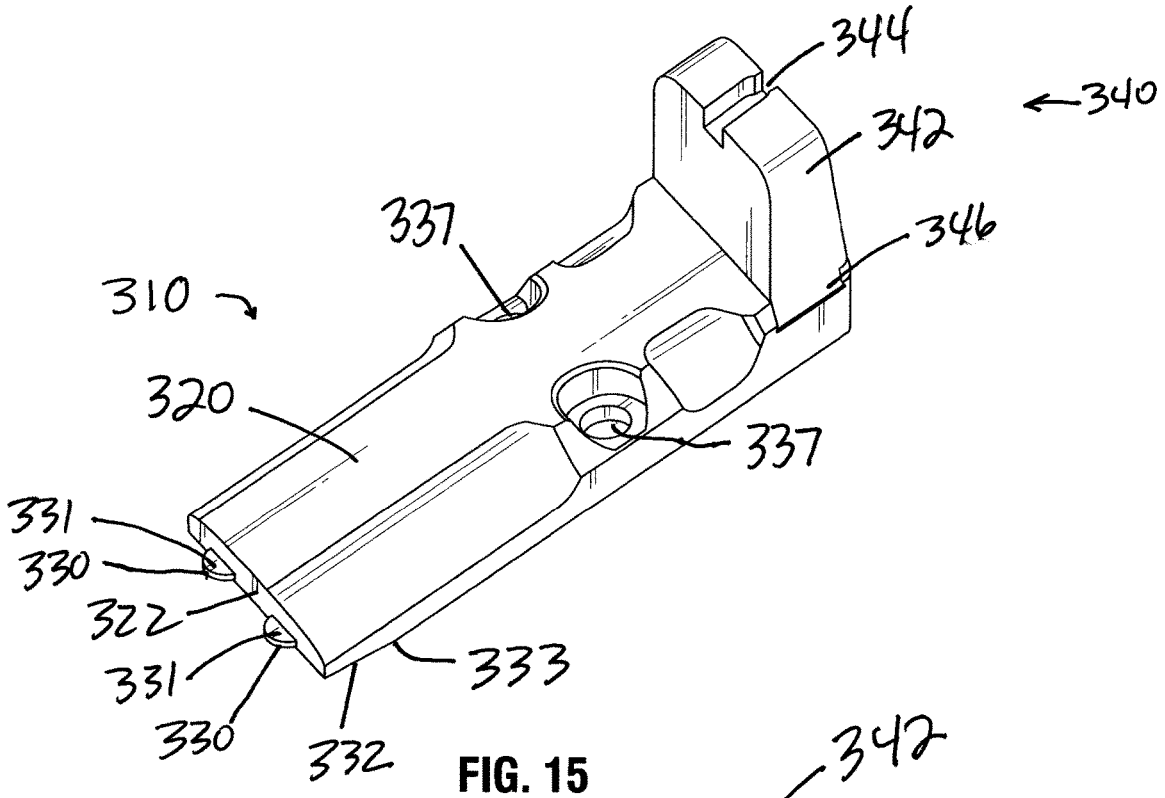
FIG. 15 is a perspective view of a base and sighting component in one embodiment.
Figure 16:
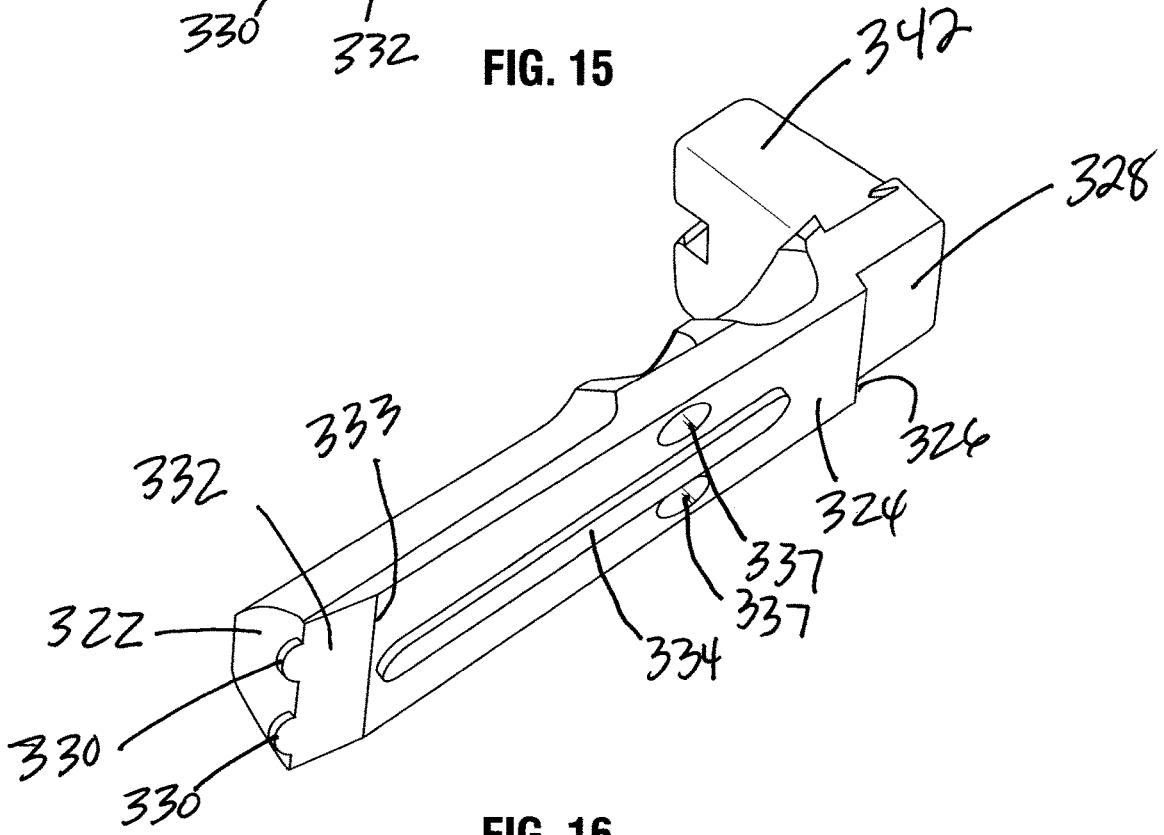
FIG. 16 is a perspective view of the base and sighting component depicted in FIG. 9.
Figure 17A:
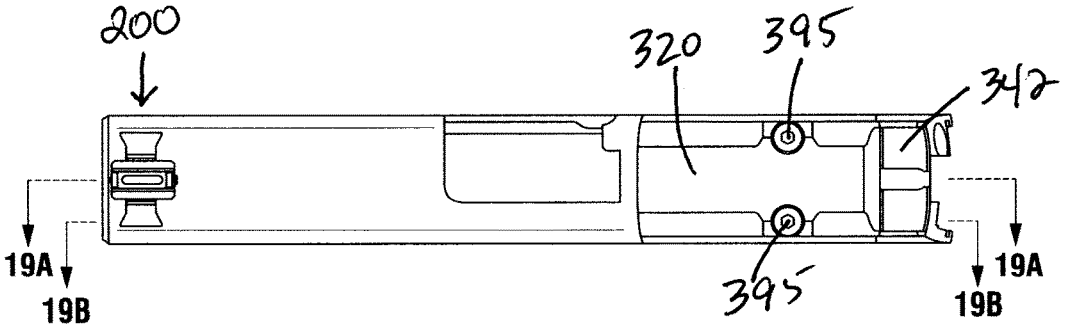
FIG. 17A is a plan view of the base and sighting component depicted in FIG. 9.
Figure 17B:
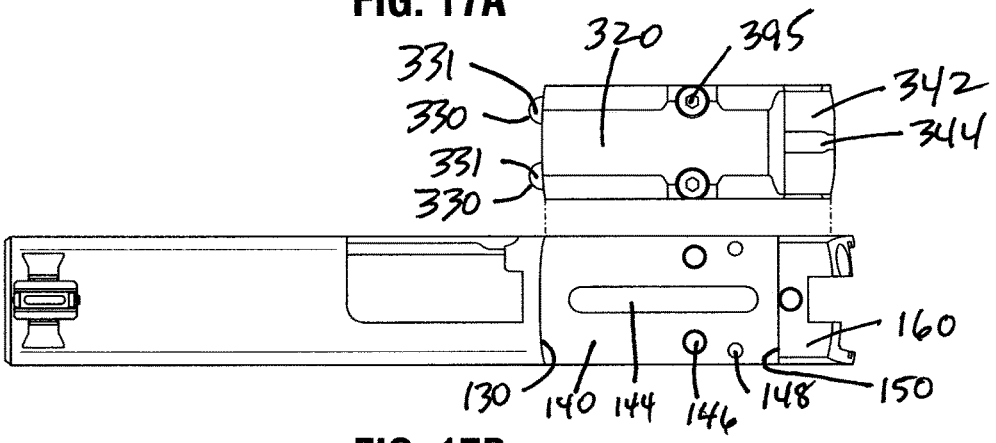
FIG. 17B is a plan view of the base and sighting component depicted in FIG. 9.
Figure 18A:
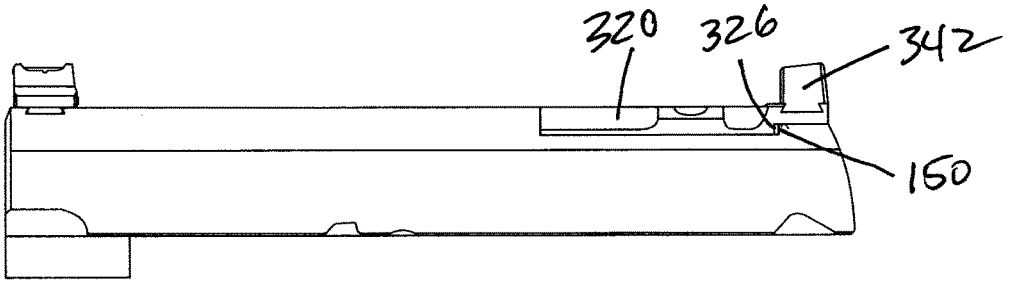
FIG. 18A is an elevation view of the base and sighting component depicted in FIG. 9.
Figure 18B:
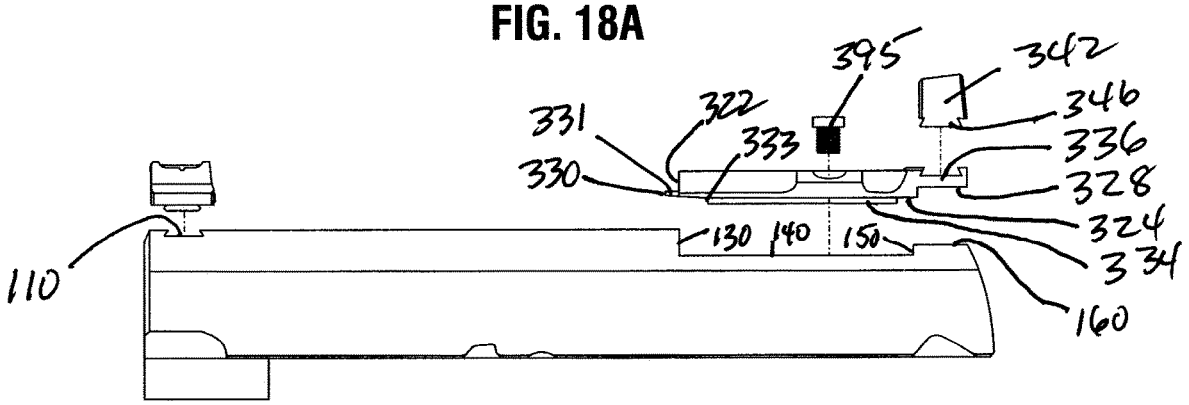
FIG. 18B is an elevation view of the base and sighting component depicted in FIG. 9.

With respect to the slide embodiment shown in FIGS. 1-8, a longitudinal direction extends in the direction of the length of the slide, so that cross-section planes 4-4, 5-5, and 6-6 shown in FIG. 2 all extend along a longitudinal direction, with the longitudinal axis lying in cross-section planes 4-4. Cross-section planes 7-7 and 8-8 in contrast extend laterally to the longitudinal direction, in this case perpendicularly.

As shown in FIGS. 1-8, slide 100 comprises front sight receiver 110 and rear sight receiver 120 separated longitudinally. Front sight receiver 110 comprises a dovetail slot extending orthogonally to the longitudinal direction. Rear sight receiver 120 comprises front wall 130, first rear sight receiver floor 140, back wall 150, and second rear sight receiver floor 160. In this example, the front sight receiver and the rear sight receiver are formed in the slide, but in other embodiments each or either may be formed in a separate component attachable (e.g., using fastening means) or bondable (e.g., using high-tack adhesive or welding) to the slide. However, forming a sight receiver directly into a frame, receiver, or slide typically will be advantageous for at least having the sighting line of the sighting component using that sight receiver closer to the path at which a projectile is ejected from the projectile launching device.

Front sight receiver 110 and rear sight receiver 120 each have generally planar surfaces forming floors. With the slide mounted to a pistol held in normal operating orientation, the normal to the front sight receiver floor 115 and the normal to rear sight receiver floors 140 and 160 would each be oriented vertically. Each, all, or some combination of floors 115, 140, and 160, however, may be non-planar and/or oriented differently. For example, any of the floors may be curvate or multifaceted, and/or be tilted front, back, to a side, or a combination thereof.

In the depicted embodiment, front wall 130 is curved and generally oriented transverse to the longitudinal direction. As discussed below with respect to the embodiment depicted in FIGS. 25-29, in the depicted embodiment the curvature of front wall 130 is formed to be complementary to the front of the base of a sighting component comprising an integral base. Other shapes and sizes of front wall 130 may be used, however, but preferably are selected to complement the various bases that are going to be used in a particular sighting system. For example, a front wall may be planar, or formed with two or more planar wall sections joined laterally across the slide, or formed with a combination of planar and curvate elements.

The embodiment depicted in FIGS. 1-8 comprises back wall 150, which separates first rear sight receiver floor 140 from second rear sight receiver floor 160. In the depicted embodiment, back wall 150 is planar and extends laterally across the slide, but as with front wall 130, other shapes and/or orientations may be used. Although optional, the use of rear wall 150 is preferred so as to facilitate attachment and stabilization of a base to the slide, preferably limiting longitudinal translation and/or rotation of a base with respect to the sight receiver. In some embodiments, as discussed below, second rear sight receiver floor 160 may support an sighting component additional to any sighting components attached directly or indirectly to first sight receiver floor 140.

In the depicted embodiment, the normals to front wall 130 and back wall 150 are generally parallel to the plane of first rear sight receiver floor 140. In other embodiments, however, different orientations of either or both of the walls may be advantageous. For example, in some embodiments it may be preferred to have front wall 130 lean backwards, or back wall 150 lean forwards, so as to cooperate with a complimentarily oriented wall of a base for attachment of that base to the slide and limit vertical movement of the base with respect to the sight receiver.

In this embodiment, rear sight receiver 120 employs several means to attach and/or stabilize a base. For example, this embodiment comprises a first slot 135 disposed on one side of front wall 130 and a second slot 135 disposed on the other side of front wall 130. Each slot 135 forms a section of a cylinder cut into front wall 130 above first rear sight receiver floor 140. This configuration, arrangement, and orientation of slots 135 is preferred, as it provides stabilization of the base on both sides of the longitudinal axis of the slide. In addition, in this embodiment the tool used to cut slots 135 in front wall 130 is elevated above first rear sight receiver floor 140, thus avoiding tool marks on that floor incurred during the machining of slots 135. Also, slots 135 may be machined in this configuration with a simple keyway cutting tool. In this embodiment, raising slots 135 above first rear sight receiver floor 140 also provides a means for tightening a base in the rear sight receiver, as discussed more fully below with respect to the embodiment of FIGS. 15-19. Alternatively, other means of forming a recess in front wall 130, for example EDM, laser, MIM, or 3D printing, may be used. Other shapes and numbers of recesses may also be used. For example, in an embodiment comprising two or more planar wall sections joined laterally across the slide, each wall section may comprise a recess, for example having a full or partial cuboid shape. In other embodiments, one or more recesses may have tapered upper and lower walls, or be made with cylindrical or conical (full or partial) borings. Alternatively, a front wall may comprise plural recesses, each having a different shape. Preferably however the shape of the recesses will be complementary to the shape of protrusions formed on a base configured to be attached to the rear sight receiver. In yet other embodiments, protrusions may be disposed on a front wall and configured to engage recesses on a base.

As depicted in FIGS. 1-8, rear sight receiver 120 comprises mortise 144 formed in the first rear receiver floor 140. As discussed below, in some embodiments mortise 144 receives a tenon when the base is assembled to the sight receiver, and thus along with the tenon forming interfitting structures as a means to at least partially restrain or retain the base and the sight receiver in longitudinal alignment and lateral alignment when assembled together, with each of the mortise and the tenon being longitudinally oriented. In this embodiment, mortise 144 extends longitudinally, but other orientations may be used. For example, a mortise may be formed extending laterally across the slide. Plural mortises, or one or more recesses having different shapes, may also be used. For example, first rear sight receiver floor 140 may comprise plural keyways, borings, tappings, or other recesses all oriented in a longitudinal direction, and configured to receive keys, pins, threadings, or other protrusions attached, attachable, or integral with a base. Alternatively, instead of a tenon or other recesses, sight receiver floor 120 may be configured with a tenon or other projection, configured, arranged, and oriented to form interfitting parts with recesses disposed on a base. Other embodiments may have a sight receiver and a base both comprising longitudinally arranged or arrayed protrusion and configured to form interfitting parts with separate male means, such as pins, keys, or splines. In yet other embodiments, a sight receiver may comprise both a recess and a protrusion, longitudinally arrayed, and configured, arranged, and oriented to interfit with at least one longitudinally arrayed protrusion and/or a recess on a base.

This embodiment uses plural tapped borings in the attachment of a base to the slide. As shown in FIGS. 1-8, a pair of tapped borings 146 are disposed in first rear sight receiver floor 140, one on each side of the longitudinal axis of the slide. In this embodiment, a single tapped boring 166 is disposed on second rear sight receiver floor 160. Each of these borings in this embodiment are generally perpendicular to the respective floors on which they are disposed. In other embodiments, however, it may be advantageous to have more or fewer tapped borings, which may be configured, arranged, and/or oriented in other ways. Preferably, the number, configuration, arrangement, and orientation of tapped borings will be selected to enhance the attachment and stabilization of bases to be used in particular embodiments.

FIGS. 1-8 also depict plural pin holes 148. In this embodiment, a pin hole 148 is disposed in first rear sight receiver floor 140 on each side of the central longitudinal axis of the slide. Each pin hole 148 comprises a cylindrical boring into the slide that is substantially perpendicular to first rear sight floor 140. Although pin holes 148 are useful to provide lateral, longitudinal, and rotational stability of a base with respect to the slide, the use of pin holes is optional. As with the tapped borings, however, in other embodiments it may be advantageous to have more or fewer pin holes, which may be configured, arranged, and/or oriented in other ways, or even no pin holes. For example, an embodiment may use plural sets of pinholes, some of which may be cylindrical borings, some of which may be keyways (e.g., for rectangular, square, parallel sunk, gib-head, feather, Woodruff, or Scotch keys), and/or some of which may be fully or partially conical, each configured to interfit with a corresponding type of pin, such as cylindrical (having ends with the same or different diameters), key shaped, or full or partial conical shaped. Preferably, the number, configuration, orientation, and/or arrangement of pin holes will be selected to enhance the attachment and stabilization of bases to be used in particular embodiments.

FIGS. 9-14 depict a front sight system embodiment used for the descriptions in this disclosure. Other embodiments of front sight systems may, and likely will, have differences in elements and configuration, arrangement, and/or orientation of elements, yet still be within the scope of one or more of the claims. In FIGS. 9-14, front sight 200 comprises base 210 and sighting component 250.

In this embodiment, base 210 comprises dovetail key 240. Dovetail key 240 comprises dovetail bevels 244 disposed lateral sides of the key, and dovetail key bottom 248. Dovetail key 240, bevels 244, and bottom 248 are sized and arranged complementary to front sight receiver 110. In some deployments of this embodiment, dovetail key 240 is impacted into front sight receiver 110 and held in place by a releasable adhesive, with or without the use of a set screw. Other embodiments, however, may use alternative means to attach a front sight base to a front sight receiver. For example, a front sight receiver may configured as a boring, with a front sight base comprising a threaded protrusion extended through the boring and held in place by a complementary threaded fastener, such as a nut. In yet other embodiments, a front sight base may be held in a front sight receiver by force applied by one or more set screws or similar devices. In still other embodiments, a ball detent or other form of resilient catching means may be used.

Front sight base 210, in this embodiment, uses additional elements to attach front sighting component 250 and retain it in alignment. For example, the depicted embodiment comprises pedestal 220 disposed on pedestal rim 230 above dovetail key 240. Pedestal 220 comprises top surface 222 and perimeter surface 224. Boring 226 extends longitudinally through pedestal 220, and has countersink tapers 228 at each end. Pedestal rim 230 comprises flat surface 234 and perimeter surface 238. Pedestal rim 230 is sized such that flat surface 234 provides a "shelf" like structure around the bottom of pedestal 220. Pedestal 220 and pedestal rim 230 are each elongated and oriented in the longitudinal direction.

Sighting component 250, in this embodiment, comprises base housing 255. As depicted, housing 255 is configured complementary to pedestal 220 and pedestal rim 230 to provide interfitting of those components, thus enhancing the attachment and stabilization of the sighting component to the base. For example, base housing 255 comprises upper cavity 260 and lower cavity 266. Upper cavity 260 comprises top wall 261 and side wall 262, which respectively are sized and configured to match pedestal top surface 222 and pedestal perimeter surface 224. Thus, upper cavity 260 and lower cavity 266 are each elongated and longitudinally oriented, forming interfitting parts with pedestal 220 and pedestal rim 230 respectively, and thusly providing means to at least partially restrain or retain base 210 and sighting component 250 in longitudinal alignment and lateral alignment when assembled together.

Lower cavity 266, in this embodiment, comprises shoulder surface 264 and side wall 268, which respectively are sized and configured to match pedestal rim flat surface 234 and pedestal rim perimeter surface 238. Housing 255 also comprises, as shown, tapped boring 280 oriented longitudinally. Tapped boring 280 receives set screw 282, which comprises drive means 284 (in this case a hex recess) and taper 286, which is disposed on the opposite end of set screw 282 from drive means 284.

As depicted in FIGS. 9-14, sighting component 250 comprises blade 270 disposed above housing 255. In this embodiment, a blade is used, but other embodiments may use different structural arrangements, for example a post, a ring, cross, notch, or similar sighting aide. As shown, blade 270 is elongated in the longitudinal direction. In this embodiment, optic fiber 271 is used as a perceptual aide, but other embodiments may use aides such as a radio luminescent source (e.g., a tritium vial) or reflecting paint or tape, or no aide at all.

When the depicted embodiment is assembled, front base 210 is attached tightly to front sight receiver 110, and sighting component 250 is firmly attached to front base 210 and securely restrained in longitudinal alignment. Upper cavity 260 and its component walls 261 and 262 fit closely to pedestal 220 and its component surfaces 222 and 224, respectively. Similarly, lower cavity 266 and its component wall 268 and shoulder surface 264 fit closely to pedestal rim 230 and its component surfaces 238 and 234, respectively. When tightened, set screw countersink taper 286 closely engages taper 228 in boring 226, thereby enhancing attachment and retention of sighting component 250 to front base 210 in longitudinal, lateral, upper, and lower directions.

As depicted, the rounded cuboid shapes of pedestal 220, pedestal rim 230, upper cavity 260, and lower cavity 266, are preferred, but other configurations may be used. For example, instead of interfitting rounded cuboid forms, the forms may generally take many other complimentary or compatible interfitting forms, such as other prism shapes (e.g., triangular, hexagonal, octagonal), cylindrical shapes, full or partial conical shapes, or semi-spherical shapes. Similarly, complementary pedestal rim flat surface 234 and lower cavity shoulder surface 264 are preferably planar and orthogonal to the adjacent walls and surfaces, but other configurations, arrangements, and/or orientations may be used in other embodiments. For example complementary shoulder surfaces may be tapered with respect to the adjacent walls and surfaces, may be curvate instead of flat, or may extend partially or intermittently around a base. In yet other embodiments, additional stabilizing and restraining means may be used, for example using complementary and compatible keys and keyways oriented around the base, which may be oriented vertically, longitudinally, laterally, or curvately.

As shown, front sight 200 uses set screw 282, boring 262, and compatible beveled or countersunk elements 284 and 244 to attach and restrain sighting component 250 to base 210. In alternate embodiments, however, another set screw may be used at the opposite end of boring 226 to increase retention. Alternatively, fastening means may be located and/or oriented in other or additional places. For example, a screw may be deployed obliquely through a sight component into a base, a pin may be disposed through both a sight component and a base (e.g., extending longitudinally, transversely, or obliquely), or a releasable adhesive may be used. In addition, interfitting structures may be used in addition to or instead of other fasteners. For example, an inwardly leaning wall inside a sight component housing may engage an outwardly leaning wall of a base to aide attachment and stabilization. In yet other embodiments, compatible dovetails may be deployed in the base and sighting component.

The embodiment of a sight system depicted in FIGS. 15-19 comprises base 310 and sighting component 340 configured, arranged, and oriented for use as a rear sight system for slide 100 depicted in FIGS. 1-9 and described above. In the depicted embodiment, the sight system is configured as a rear fixed notch iron sight for use with the blade front sight embodiment depicted in FIGS. 9-14.

As illustrated, base 310 comprises rear base body 320. Depicted rear base body 320 comprises front face 322, first bottom surface 324, rear face 326, and second bottom surface 328, which respectively are configured to be compatible and complementary with front wall 130, first rear sight receiver floor 140, back wall 150, and second rear sight receiver floor 160, of slide 100. Bevel surface 332, however, meets front face 322 and first bottom surface 324 at obtuse angles, so that the lower portion of front wall 130 and the front portion of first rear sight receiver floor 140 have no directly adjacent counterparts on rear base body 320. Nevertheless, substantial portions rear base body 320 match corresponding portions of rear sight receiver 120, which is sufficient to render those parts interfitting. Thus, front face 322 has curvature and orientation substantially similar to front wall 130, first bottom surface 324 and second bottom surface 328 have substantially planar surfaces similar to first rear sight receiver floor 140 and second rear sight receiver floor 160, and rear face 326 is substantially planar similar to back wall 150. Similarly as described above with respect to rear sight receiver 120, though, front face 322, first bottom surface 324, rear face 326, and second bottom surface 328 may have different shapes, configurations, arrangements, and/or orientations, but preferably the surfaces on a base body and the surfaces on a sight receiver that are closely adjacent will be compatible and complementary. Preferably, the tolerances of the interface of front face 322 to front wall 130 and the interface of rear face 326 to back wall 150 are tight enough to substantially reduce or eliminate longitudinal translation and rotation of rear base 310 with respect to rear sight receiver 120.

Figure 38A:
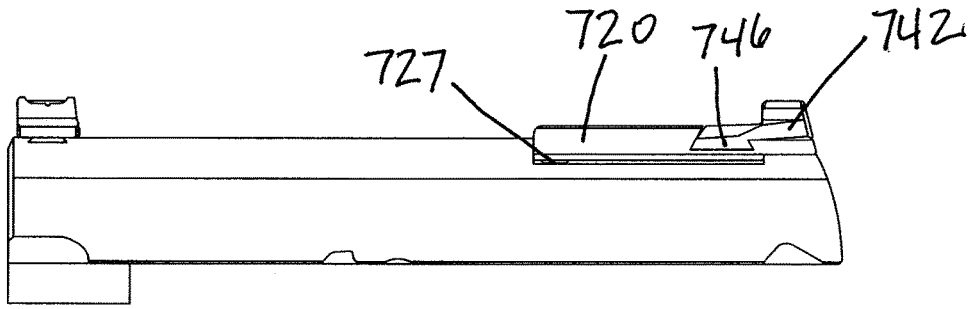
FIG. 38A is an elevation view of the base and sighting component depicted in FIG. 35.
Figure 38B:
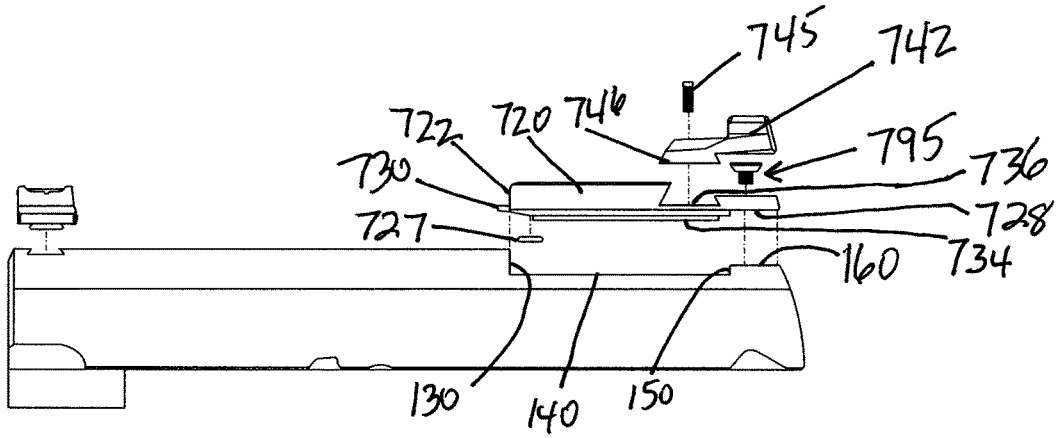
FIG. 38B is an elevation view of the base and sighting component depicted in FIG. 35.
Figure 38C:
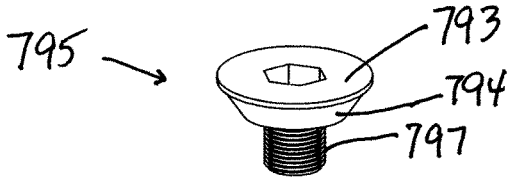
FIG. 38C is a perspective view of an embodiment of a fastener useful to attach the base depicted in FIG. 35 to a sight receiver.
Figure 38D:
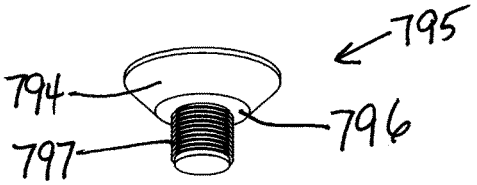
FIG. 38D is another perspective view of the fastener depicted in FIG. 38C.

As illustrated, rear base body 320 comprises dovetail slot 336 sized, arranged, and oriented to accommodate dovetail key 346 on sighting component body 342 of sighting component 340. Preferably, dovetail key 346 is impacted into dovetail slot 336 and held in place by a releasable adhesive. Optionally, a set screw may be used to augment or provide retention of sighting component body 342 in place on rear base body 320, for example similar to screw 745 depicted in FIGS. 38B and 39A. Other embodiments, however, may be configured, arranged, and/or oriented in other ways, for example as discussed above with respect to front sight receiver 110 and front sight base 210. In this embodiment, sighting component body 342 is configured as a fixed iron sight comprising sighting notch 344, with dimensions compatible with the height and width of front sight 200 and the ballistics of the projectile launching device. Other embodiments, however, may use different iron sights or optic sights suitable for the size, arrangement, and orientation of the projectile launching device, the sight receiver, and the sight base.

Rear base body 320 depicted in FIGS. 15-19 also comprises a pair of juts 330 protruding from front face 322. Juts 330 are disposed on opposite sides of the longitudinal axis, in locations corresponding to slots 135 in front wall 130 of slide 100 when base 310 is fully installed (as described later). In addition, each of juts 330 is sized to be accommodated in the corresponding slot 135. Thus, when rear base 310 is installed and attached to rear sight receiver 120, a substantial portion of each jut 330 will be disposed in corresponding slot 135. As depicted, the lower surface of each jut 330 is a continuation of bevel surface 332, but either or both of juts 330 may be located higher on front face 322 such that there is a discontinuity between the lower surface of the juts and the bevel surface. As discussed above with respect to slots 135, juts 330 or other protrusions may be configured, arranged, and/or oriented in other ways, but preferably so that each protrusion is compatible and complementary with its corresponding recess (e.g., slot 135) when base 310 is fully installed (as described later). Alternatively, front face 322 may be configured with recesses corresponding to protrusions on front wall 130.

In the depicted embodiment, rear base body 320 also comprises tenon 334. The depicted tenon 334 forms a rounded cuboid elongated along the longitudinal direction and centered in the middle of rear base body 320. In this embodiment, tenon 334 is sized, located, and oriented to be compatible and complementary with mortise 144 of rear sight receiver 120 when base 310 is installed in rear sight receiver 120. Preferably, the sizing tolerances of tenon 334 and mortise 144 are tight enough to substantially reduce any lateral translation and any rotation of rear base 310 with respect to rear sight receiver 120. Preferably the length of tenon 334 closely matches the length of mortise 144 to further reduce any longitudinal translation of the parts, but this tolerance may readily be compensated by the interface of front face 322 to front wall 130, along with the interface of rear face 326 to back wall 150. Preferably, the height of tenon 334 closely matches the depth of mortise 144, but in applications where vibration may be a concern, the height of tenon 334 may be less than the depth of mortise 144 so as to accommodate a dampening agent (such as grease, foam, or an elastomeric compound) to fill the void between the bottom of mortise 144 in the bottom of tenon 334 when base 310 is assembled with sight receiver 120. As an alternative to having tenon 334 integral with rear base body 320, a tenon may be formed as a separate, independent element, with corresponding mortises machined in both rear sight receiver 120 and rear base body 320. In this embodiment, tenon 334 and mortise 144 are interfitting structures forming means to at least partially restrain or retain base 310 and sight receiver 210 in longitudinal alignment and lateral alignment when assembled together, with tenon 334 and mortise 144 being longitudinally oriented.

FIGS. 15-19 depict rear base body 320 as comprising borings 337. Borings 337 in this embodiment are sized to receive the shanks of screws 395 without interference. In turn, the shank threads of screw 395 are sized and threaded complementary to the size and threads of tapped hole 146 in rear sight receiver 120. Accordingly, borings 337 are located on rear base body 320 so as to align with tapped holes 146 when base 310 is attached to rear sight receiver 120 using screws 395. The depicted embodiment uses two socket head screws 395 as part of the means of fastening rear base body 320 to rear sight receiver 120, but the fastening means may be configured, arranged, and/or oriented in other ways and use different numbers of fasteners, provided those fastening means are sufficient to substantially attach and stabilize rear base body 320 with rear sight receiver 120.

Figure 19A:
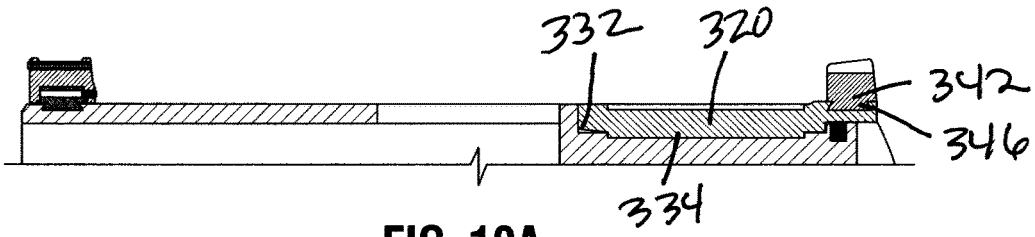
FIG. 19A is a section view of the base and sighting component depicted in FIG. 9 taken upon section plane 19A-19A indicated on FIG. 17A.
Figure 19B:
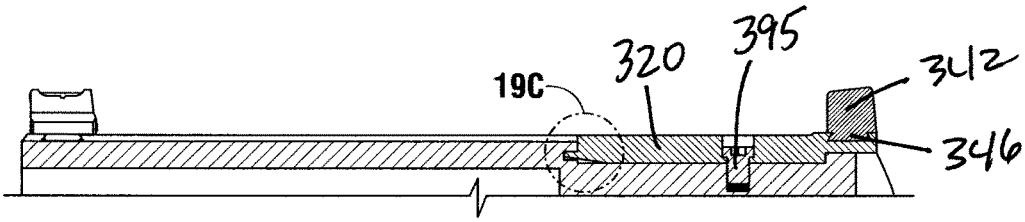
FIG. 19B is a section view of the base and sighting component depicted in FIG. 9 taken upon section plane 19B-19B indicated on FIG. 17A.
Figure 19C:
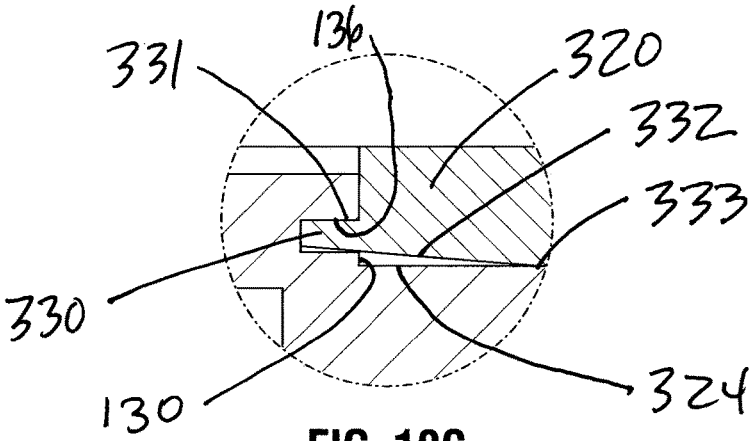
FIG. 19C is a detail view of the section area enclosed by dashed circle 19C in FIG. 19B.
Figure 19D:
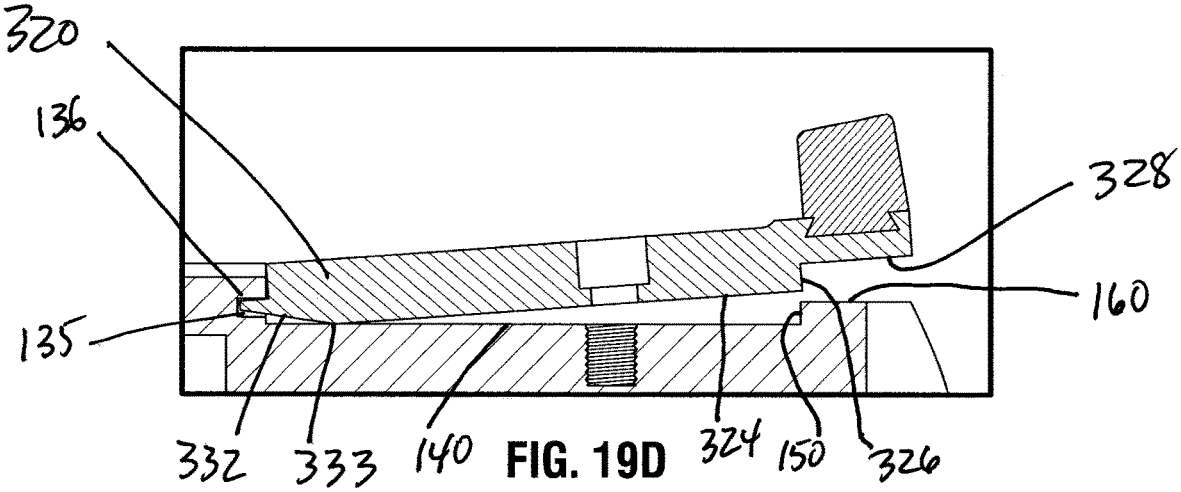
FIG. 19D is a portion of section view taken upon section plane 19B-19B indicated on FIG. 17A showing the position of the base at a non-final step of an assemble method in one embodiment.
Figure 20:
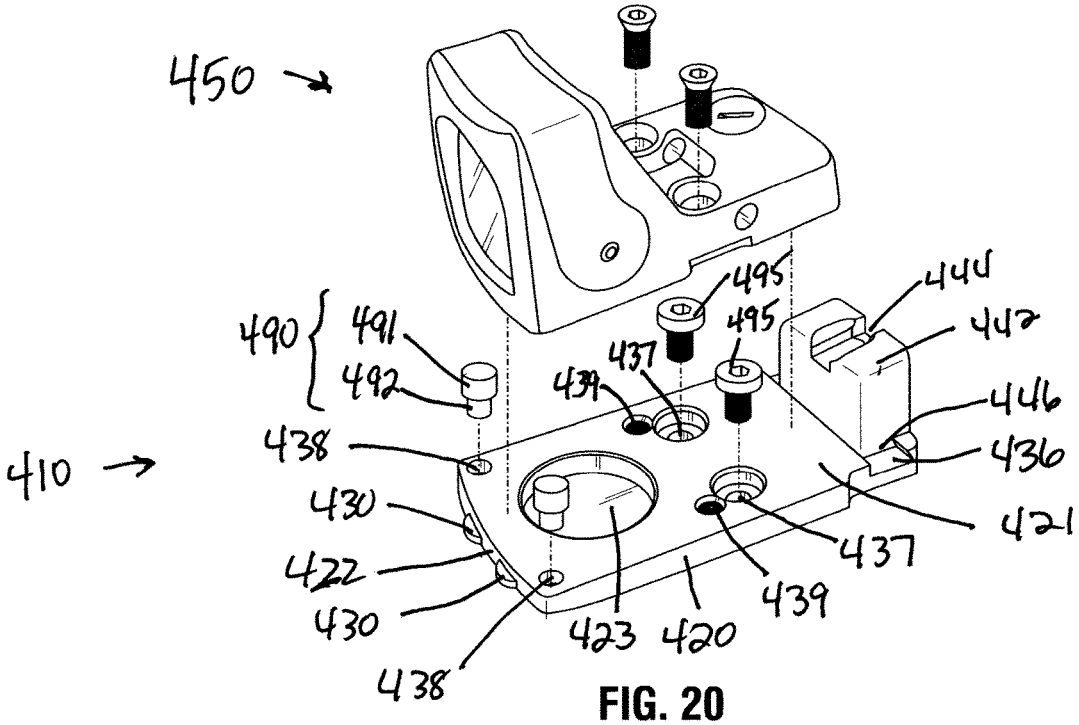
FIG. 20 is a perspective view of a base and sighting component in one embodiment.
Figure 21:
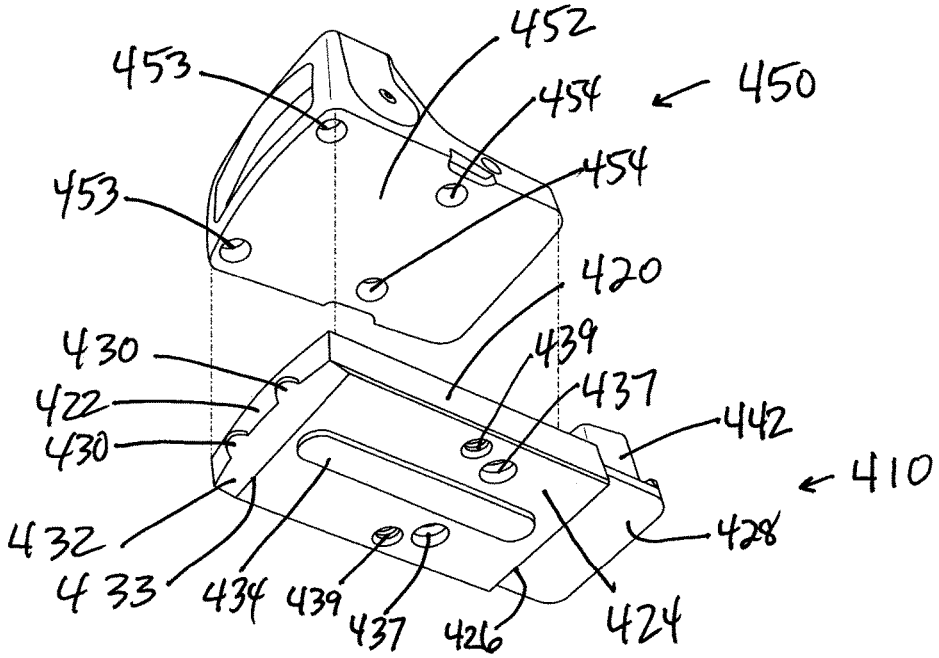
FIG. 21 is a perspective view of the base and sighting component depicted in FIG. 20.
Figure 22A:
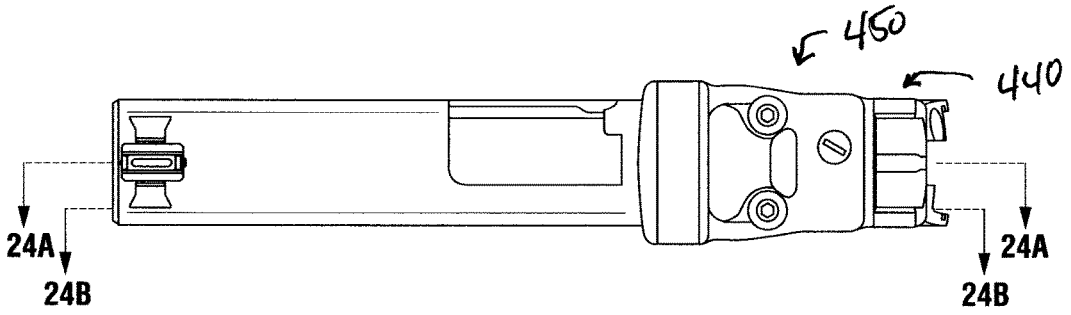
FIG. 22A is a plan view of the base and sighting component depicted in FIG. 20.
Figure 22B:
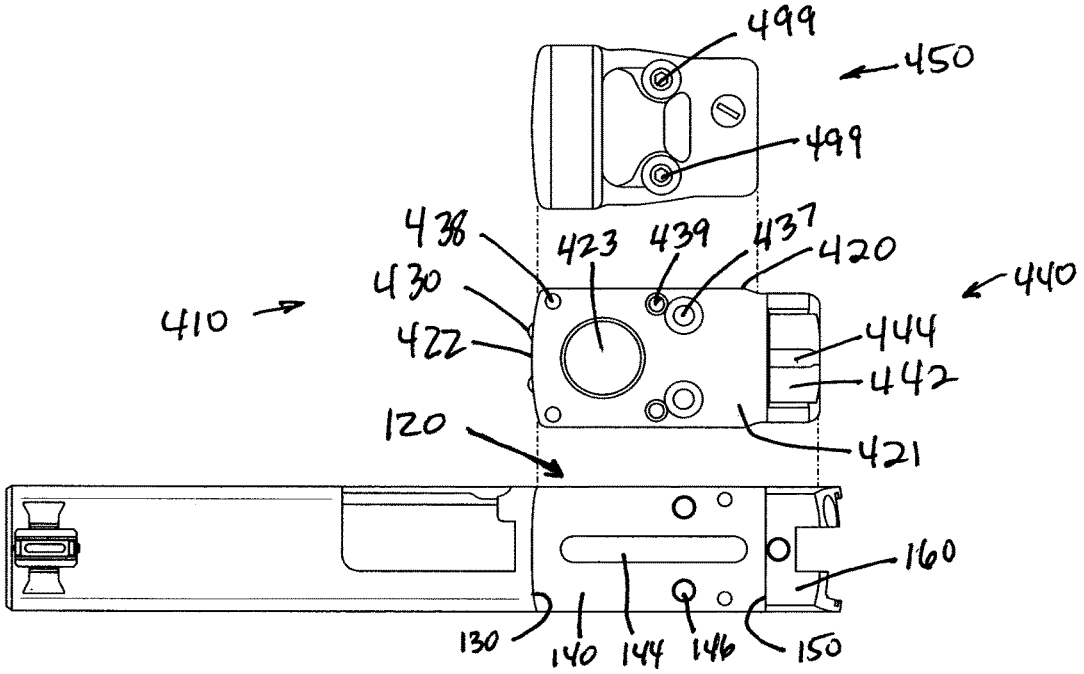
FIG. 22B is a plan view of the base and sighting component depicted in FIG. 20.
Figure 23A:
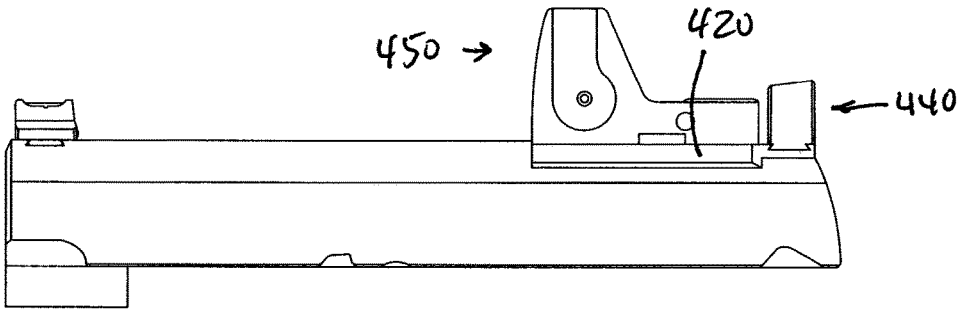
FIG. 23A is an elevation view of the base and sighting component depicted in FIG. 20.
Figure 23B:
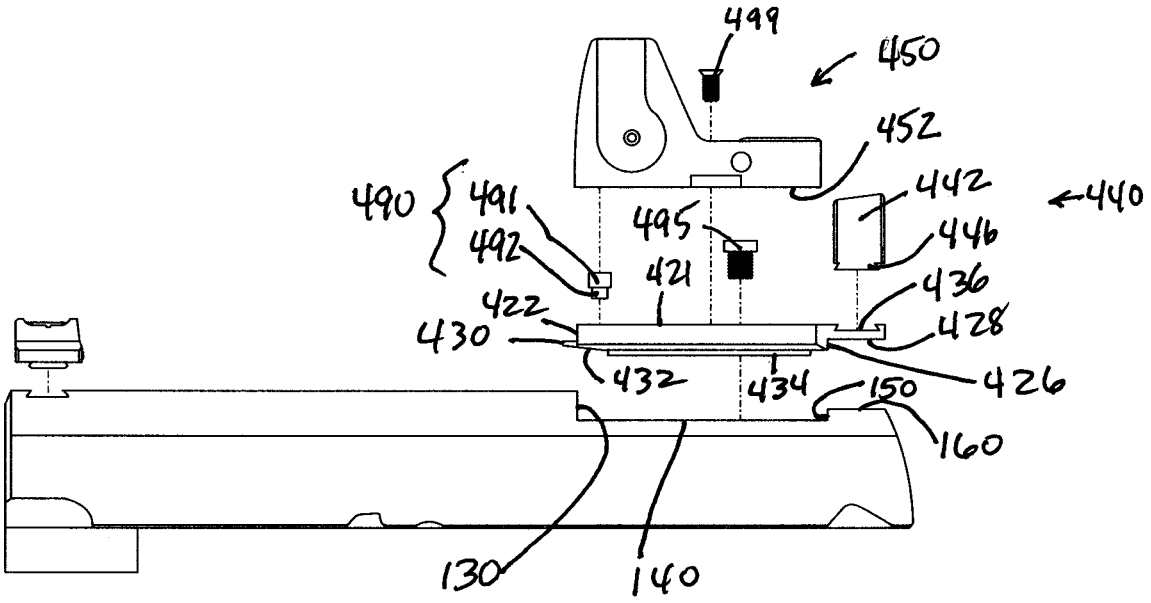
FIG. 23B is an elevation view of the base and sighting component depicted in FIG. 20.
Figure 24A:
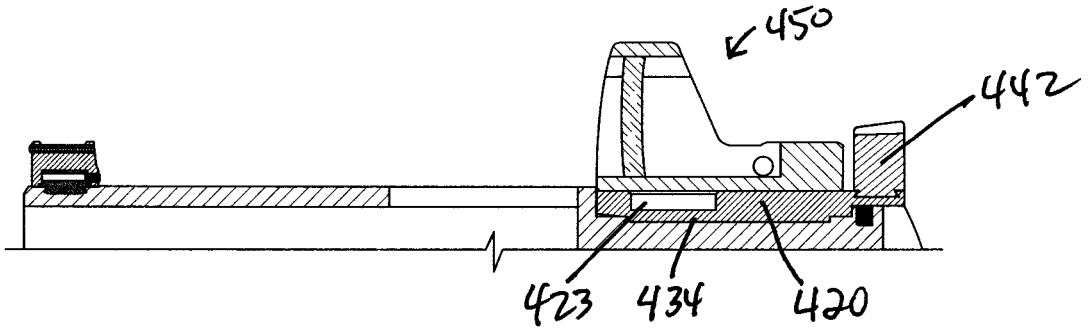
FIG. 24A is a section view of the base and sighting component depicted in FIG. 20 taken upon section plane 24A-24A indicated on FIG. 22A.
Figure 24B:
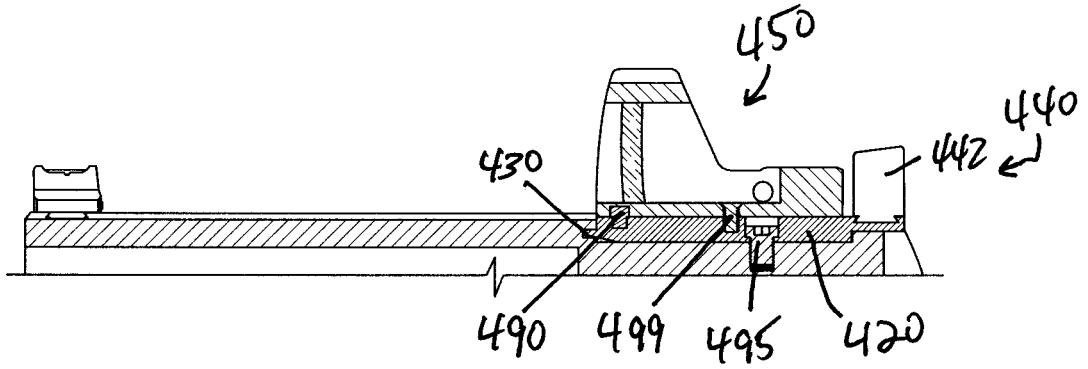
FIG. 24B is a section view of the base and sighting component depicted in FIG. 20 taken upon section plane 24B-24B indicated on FIG. 22A.
Figure 25:
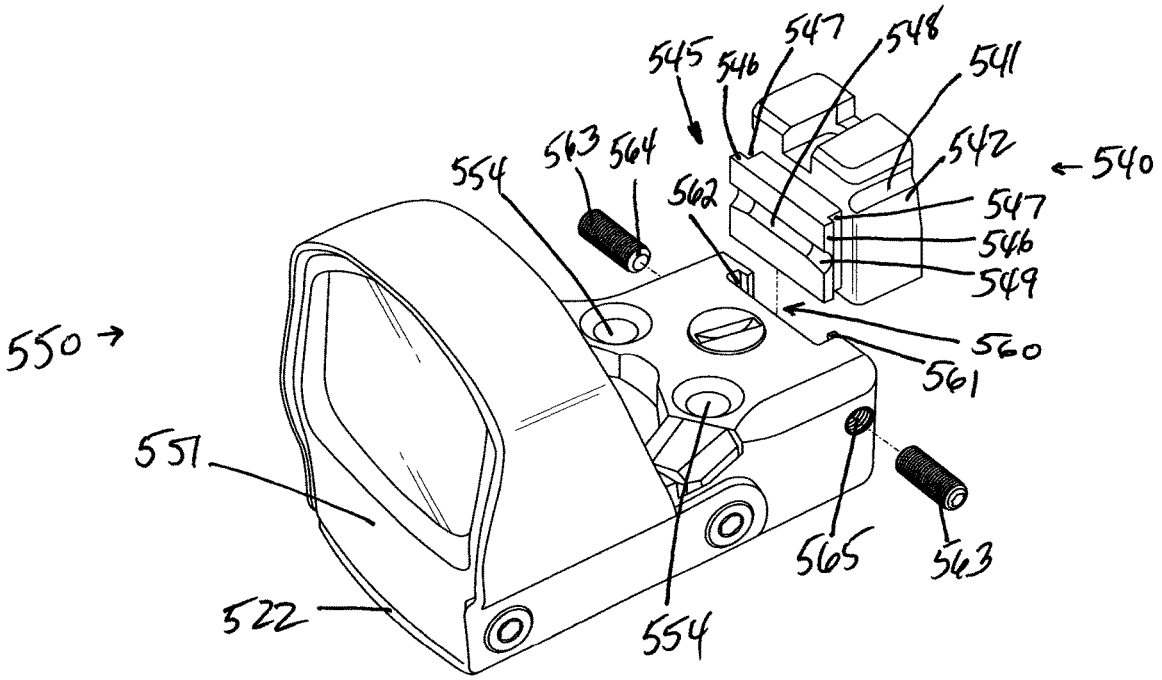
FIG. 25 is a perspective view of an integrally formed base and sighting component in one embodiment.
Figure 26:
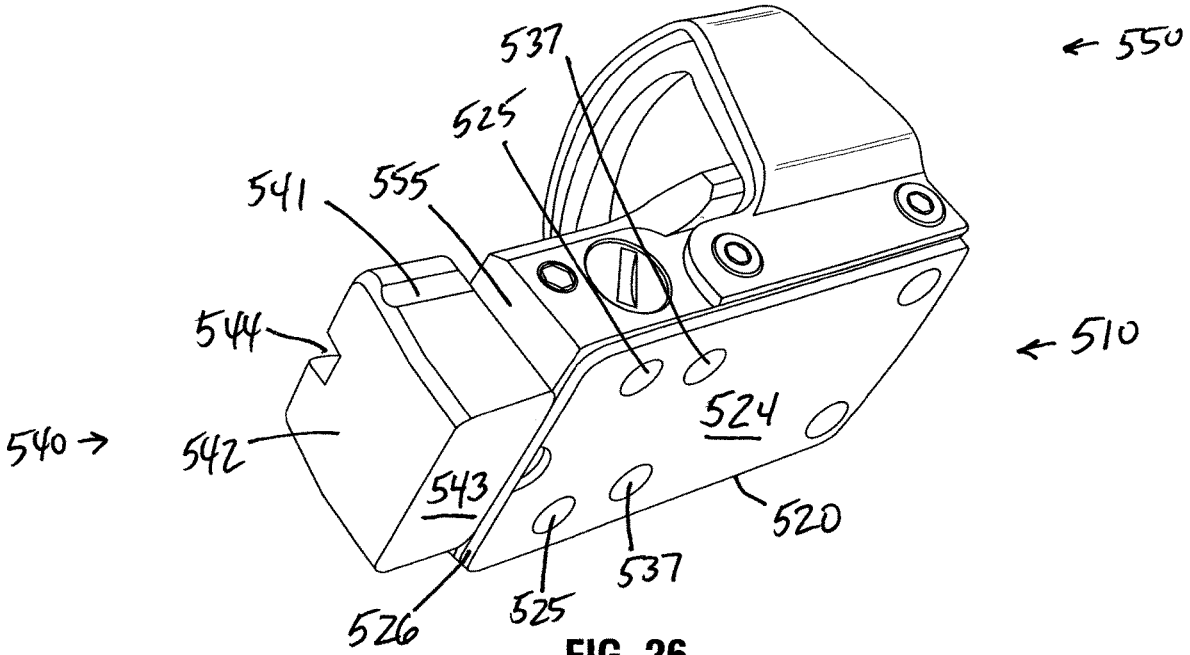
FIG. 26 is a perspective view of the integrally formed base and sighting component depicted in FIG. 25.
Figure 27A:
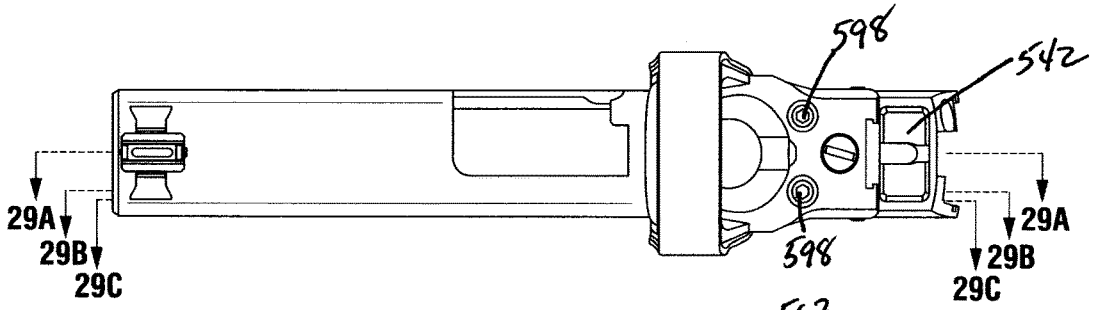
FIG. 27A is a plan view of the integrally formed base and sighting component depicted in FIG. 25.
Figure 27B:
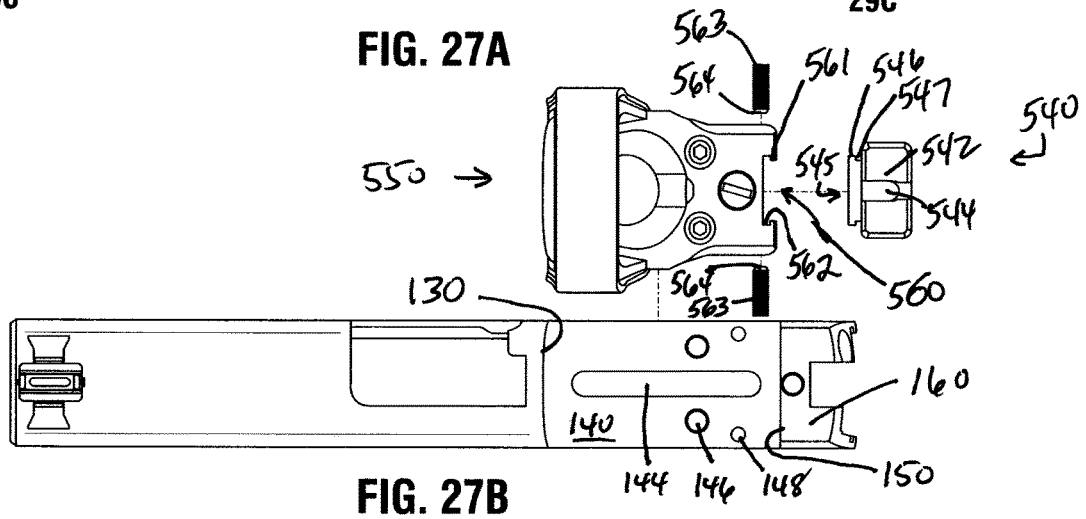
FIG. 27B is a plan view of the integrally formed base and sighting component depicted in FIG. 25.
Figure 28A:
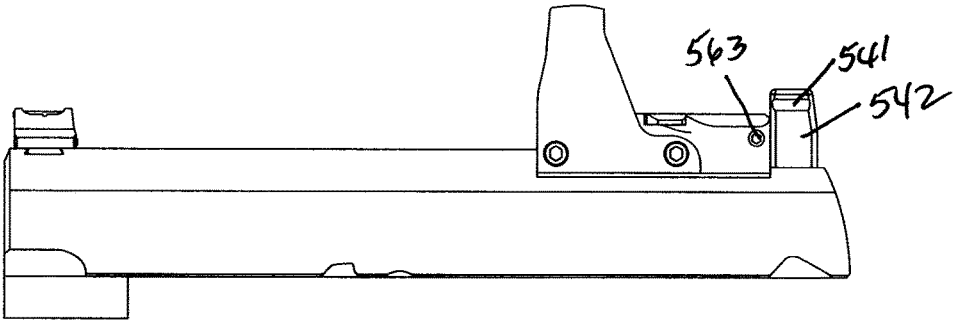
FIG. 28A is an elevation view of the integrally formed base and sighting component depicted in FIG. 25.
Figure 28B:
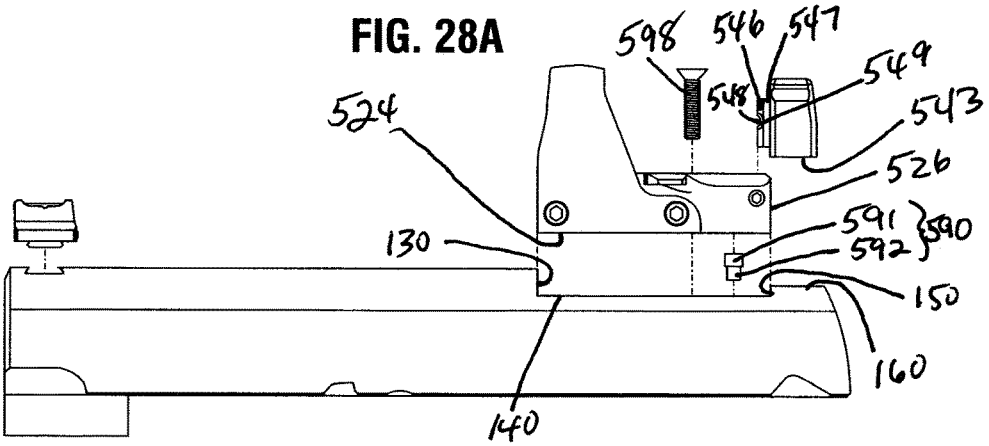
FIG. 28B is an elevation view of the integrally formed base and sighting component depicted in FIG. 25.
Figure 29A:
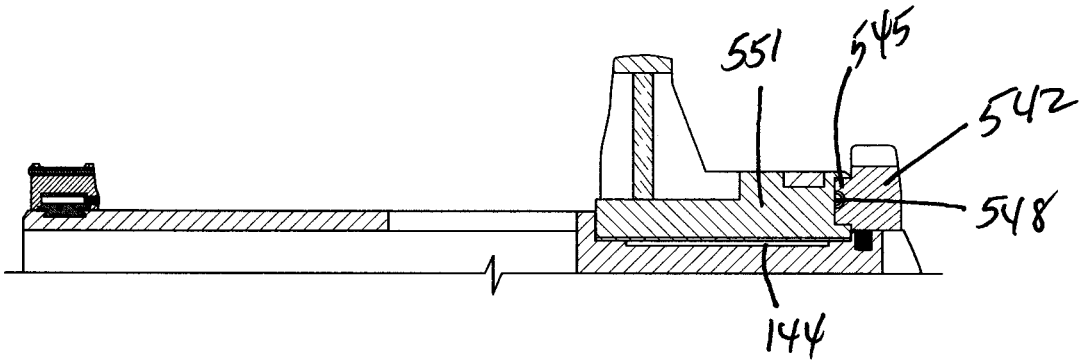
FIG. 29A is a section view of the integrally formed base and sighting component depicted in FIG. 25 taken upon section plane 29A-29A indicated on FIG. 27A.
Figure 29B:
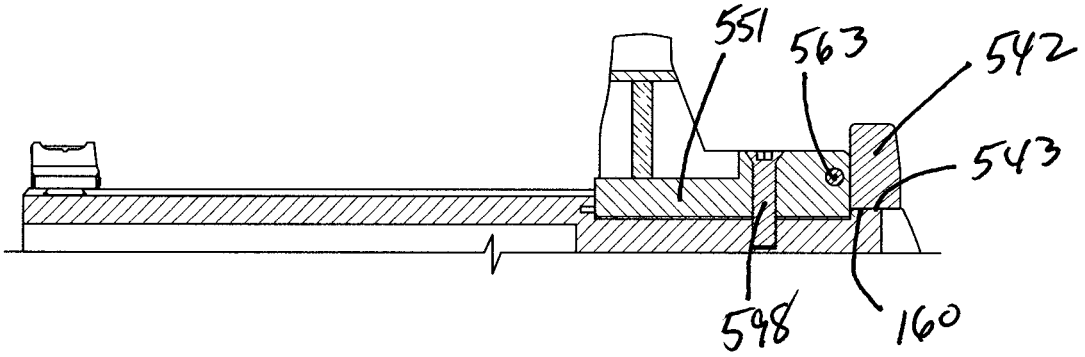
FIG. 29B is a section view of the integrally formed base and sighting component depicted in FIG. 25 taken upon section plane 29B-29B indicated on FIG. 27A.
Figure 29C:
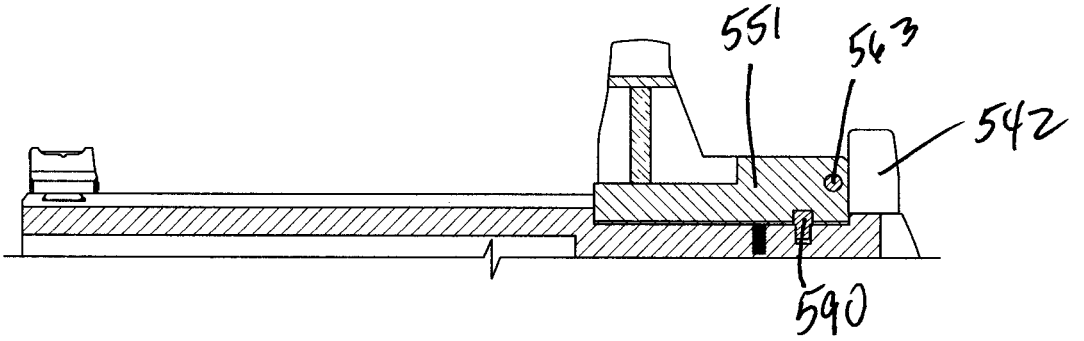
FIG. 29C is a section view of the integrally formed base and sighting component depicted in FIG. 25 taken upon section plane 29C-29C indicated on FIG. 27A.
Figure 30:
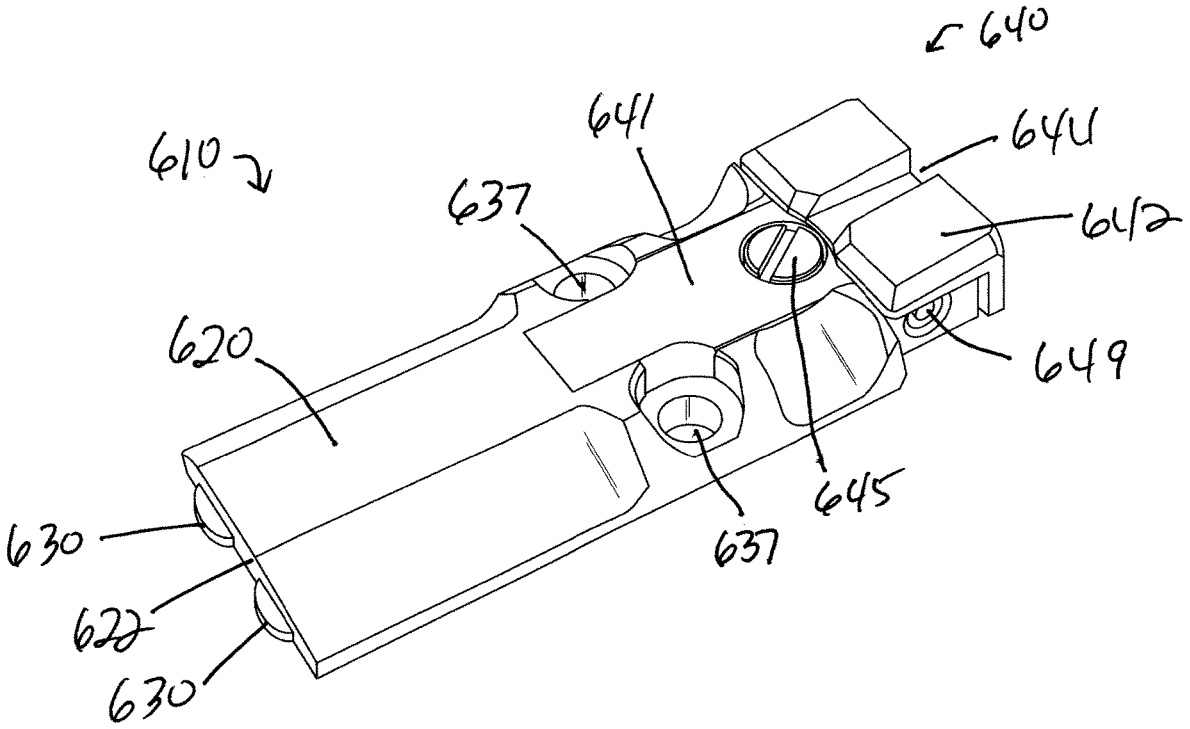
FIG. 30 is a perspective view of an integrally formed base and sighting component in one embodiment.
Figure 31:
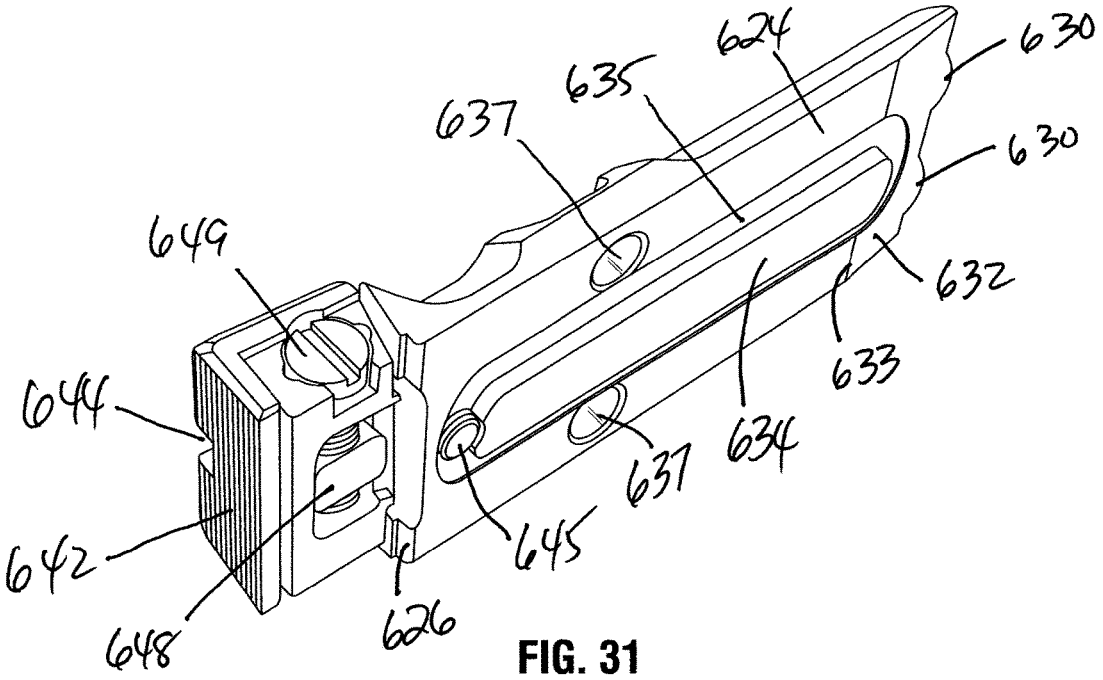
FIG. 31 is a perspective view of the integrally formed base and sighting component depicted in FIG. 30.

FIGS. 19C and 19D depict an optional method useful to attach and stabilize base 310 with sight receiver 120. Bevel surface 332 in the depicted embodiment is substantially planar and intersects with substantially planar first bottom surface 324 along intersection line 333. In this embodiment, intersection line 333 is substantially orthogonal to the longitudinal direction. A preferred method of fastening and stabilizing base 310 with sight receiver 120 comprises the following steps:

- inserting each jut 330 into its corresponding slot 135 with the top 331 of that jut against the top 136 of that slot, while first bottom surface 324 is held at an angle to first rear sight receiver floor 140;
- contacting intersection line 333 with first sight receiver floor 140 while first bottom surface 324 and first sight receiver floor 140 are held in angular orientation and juts 330 are held in slots 135;
- applying a downward force to the end of base body 320 opposite juts 330 to impose a rotation of base body 320 about intersection line 333, until second bottom surface 328 contacts second rear sight receiver floor 160, thus causing the tops 136 of slots 135 to impose a downward force against the tops 331 of juts 330;
- inserting each screw 395 through a boring 337 and engaging the threads of that screw 395 with the threads of a tapped hole 146 corresponding with that boring 337; and
- tightening each screw 395 with a torque appropriate for the size and thread configuration of screws 395, thus causing screws 395 to impose a downward force against base body 320 at the location of borings 337.

The downward forces against tops 331 of juts 330 imposed by tops 136 of slots 135 impose first moments about intersection line 333 in a first direction, and that the downward forces against base body 320 at the locations of borings 337 impose second moments about intersection line 333 in a second direction, and that the directions of the first moments are substantially opposite the directions of the second moments. These moments and the resulting stresses and strains imposed in base body 320 enhance the attachment and stabilization of base body 320 with rear sight receiver 120, for example by reducing translations and rotations of base body 320 with respect to rear sight receiver 120 and by reducing vibration of base body 320 caused by the reciprocation of slide 100.

To accomplish the above-described optional method of attaching and stabilizing base 310 with sight receiver 120, the height of tops 136 of slots 135 above first rear sight receiver floor 140 are slightly shorter than the height of corresponding tops 331 of juts 330 above the plane in which first bottom surface 324 lies. The differences in heights preferably are calibrated to the modulus of elasticity of base body 320, with a material having a higher modulus requiring less height difference compared to a material having a lower modulus. As an alternative to this optional method, embodiments may rely on tight tolerances of interfitting parts, releasable adhesives, elastomeric dampening components, and/or other means. Regardless of whether this optional method is used, the lower edge of rear face 326 and the upper edge of back wall 150, or both, may be round or chamfered to provide additional clearance of those edges when base 310 is rotated into rear sight receiver 120 thus enabling the use of a closer fit of back wall 150 with rear face 326.

In the depicted embodiment, the top external surfaces of rear base body 320 are contoured to match the adjacent surfaces of slide 100 and provide smooth transitions between those adjacent external surfaces.

FIGS. 20-24 depict an embodiment of a sight system comprising two sighting components, with this sight system configured, arranged, and oriented for use as a rear sight system for slide 100 depicted in FIGS. 1-9 and described above. First sighting component 440 is a fixed open sight configured with a sighting notch, and second sighting component 450 is a reflex sight. In the depicted embodiment, second sighting component 450 comprises a bottom surface 452, pin holes 453 disposed on a bottom surface 452 that accept pins 490 restraining translation and rotation of sighting component 450 about base top surface 421, and through holes 454 passing through the body of sighting component 450 and accepting screws 495 that sighting component 450 to base 410. First sighting component 440 comprises body 442, sighting notch 444, and dovetail key 446 that attaches sighting component 440 to base 410 by interfitting with dovetail slot 436.

In the depicted embodiment base 410 comprises base body 420. As shown, base body 420 comprises base top surface 421. In this example, bottom surface 452 of second sighting component 450 is substantially planar. Accordingly, base top surface 421 is preferably configured to be substantially planar and the sized compatibly and complimentarily with bottom surface 452. In other embodiments, base top surface 421 may have other configurations, arrangements, and orientations, but preferably still would be compatible and complementary with the bottom surface of the sighting component used in those embodiments.

In this embodiment, top surface 421 further comprises recess 423, pin borings 438, threaded boring 439, through boring 437, and dovetail slot 436, each configured, arranged, and oriented as depicted in FIGS. 20-24. Recess 423 primarily serves to reduce the weight of base body 420, which typically is an important consideration on a sight system embodied on a reciprocating slide. In some embodiments, however, recess 423 may be configured for storage of a spare battery for use in sighting component 450. In yet other embodiments, one or more recesses may be configured, arranged, and oriented to reduce vibration imposed by the reciprocation of slide 100 during firing of the projectile launching device.

Figure 44A:
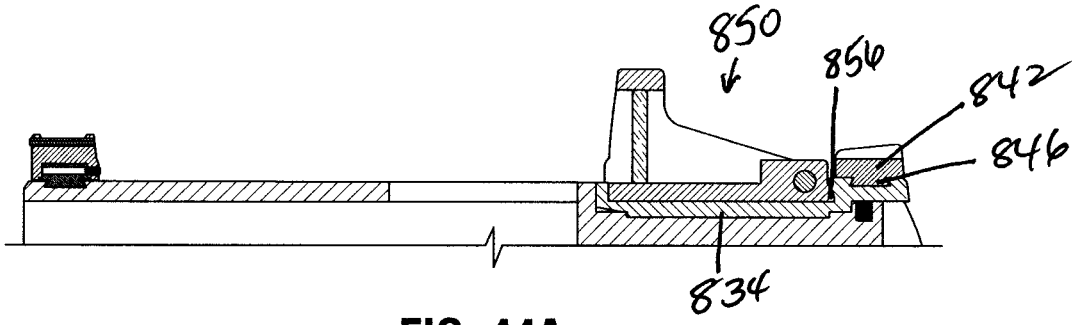
FIG. 44A is a section view of the base and sighting component depicted in FIG. 40 taken upon section plane 44A-44A indicated on FIG. 42A.
Figure 44B:
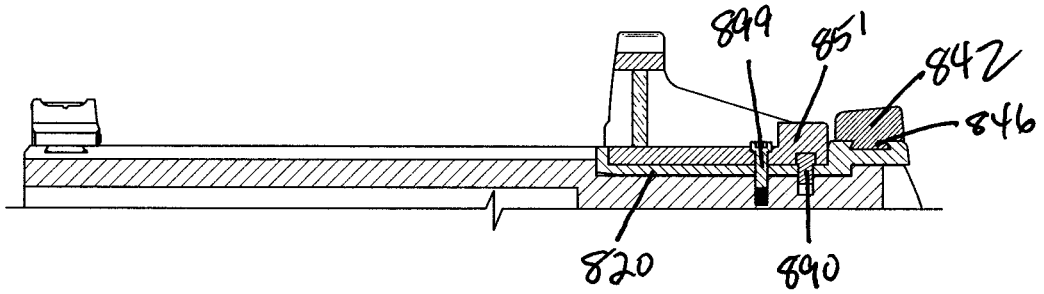
FIG. 44B is a section view of the base and sighting component depicted in FIG. 40 taken upon section plane 44B-44B indicated on FIG. 42A.

Pin borings 438, in this embodiment, are oriented and arranged to be adjacent to pin holes 453 in bottom surface 452 of sighting component 450 when sighting component 450 is attached to base body 420. Preferably, pin borings 438 and pin holes 453 are substantially cylindrical, and are substantially collinear when sighting component 450 is attached to base 410. In this embodiment, the ends 491 of pins 490 configured for insertion in pin holes 453 have a diameter larger than the diameter of the ends 492 of pins 490 configured for insertion in pin borings 438, with the transition between the two sizes forming a planar disk supported on base top surface 421 when the pin is inserted in base top surface 421, for example as shown in FIGS. 23B, 24B, 40, 43B, and 44B. The use of dual sized pins is optional, but in this embodiment and others may enhance the restraint of sighting component 450 against translation and rotation about base top surface 421 by having a flat surface at the transition in size between ends 491 and 492 that rests on the flat surface of base top surface 421, thus reducing tilting of pin 490 that might otherwise result from slight differences in the diameters of pin ends 492 and pin borings 438 that may result from even relatively tight manufacturing tolerances. In this embodiment and others, the use of dual-sized pins also provides a way of compensating for loose machining tolerances in the manufacture of sighting component 450. Thus, with tighter fabrication tolerances for pin borings 438 and pins 490 but looser tolerances for pin holes 453, the range of diameters of pin holes 453 resulting from the looser tolerances may be accommodated by selecting the appropriate pin 490 from a selection of pins 490 all having the same diameter of small ends 492 but a range of diameters of large ends 491. Additionally, by having an assortment of pins 490 having various diameters of large ends 491 but constant diameters of small ends 492, base 410 may be manufactured with a single specification but still accommodate sighting components from different vendors that use different sizes for pin holes 453. The use of dual-sized cylindrical pins is preferred, but other forms of pins may also be used, for example pins having a cuboid or other polygonal prismatic shape, with or without dual-sized ends, or keys. As shown, pin borings 438 are blind, i.e., do not extend through base body 420, but in other embodiments the pin borings may be through holes, for example as depicted in FIG. 44B.

In this example, threaded borings 439 are oriented and arranged to be adjacent to fastener through holes 454 of sighting component 450 when it is attached to base body 420. As shown, threaded borings 439 preferably extend through base body 420, primarily for ease of tapping the threads during manufacture, but blind threaded borings may be used in other embodiments. When sighting component 450 is attached to base body 420, screws 499 extend through holes 454 in sighting component 450 and thread into threaded borings 439. As shown, screws 499 have a hex drive in a countersunk head, but other driving means and screw heads may be used in other embodiments.

Through borings 437 of this embodiment extends through base body 420 and comprise upper and lower portions. The upper portions of through borings 437 have diameters larger than the diameters of the lower portions of through borings 437, with a planar disk formed at the junction of the upper portions and lower portions. The upper portions of through borings 437 are sized to fully accommodate the heads of screw screws 495, thus allow clearance of base top surface 421 without interference with the mounting of a sighting component 450 on base body 420. As shown, screws 495 are hex headed socket screws, but other driving means and screw heads may be used in other embodiments, perhaps with appropriate accommodations the configuration of through borings 437 to accommodate the selected screw head type. For example, if a countersunk screw head is selected, the transition between the upper portions of the through borings and the lower portions of the through borings may be tapered complimentarily to the configuration of the countersunk head.

As depicted, first sighting component 440 is attached to base body 420 by means of dovetail slot 436. The descriptions of the configuration, arrangement, orientation, and attachment of sighting component 340 provided above with respect to the embodiment of FIGS. 15-19 fully applies to the configuration, arrangement, orientation, and attachment of sighting component 440, and will not be repeated. It should be noted, however, that similar components of sighting components 340 and 440 have descriptive reference numbers that differ by 100, for example dovetail slot 336 is similar to dovetail slot 436 for purposes of the descriptions provided herein.

Base body 420 of this embodiment further comprises front face 422, first bottom surface 424, rear face 426, second bottom surface 428, juts 430, bevel surface 432, intersection line 433, and tenon 434. The description provided above with respect to the embodiment of FIGS. 15-19 regarding front face 322, first bottom surface 324, rear face 326, second bottom surface 328, juts 330, bevel surface 332, intersection line 333, tenon 334, and the fastening and stabilization of base 310 with rear sight receiver 120 apply fully to front face 422, first bottom surface 424, rear face 426, second bottom surface 428, juts 430, bevel surface 432, intersection line 433, tenon 434, and the fastening and stabilization of base 410 with rear sight receiver 120, and will not be repeated, except to note that in this embodiment also, tenon 434 and mortise 144 are interfitting structures forming means to at least partially restrain or retain base 410 and sight receiver 210 in longitudinal alignment and lateral alignment when assembled together, with tenon 434 and mortise 144 being longitudinally oriented. It should be noted, however, that during final assembly of the sight system depicted in FIGS. 20-24, base 410 should be attached to sight receiver 120 and screws 495 completely tightened, prior to the attachment of sighting component 450 to base 410.

FIGS. 25-29 depict an embodiment comprising two sighting components, with base 510 integral with first sighting component 550 and with second sighting component 540 mountable to first sight component 550. In this embodiment, rear sight receiver 120 is configured to be compatible and complementary with base 510, so that no separate base is needed to attach sighting component 550 to sight receiver 120. In this embodiment sighting component 550 actually has a separately identifiable integral portion serving as base 510, but in other embodiments the sighting component may simply have a lower portion comprising mounting elements serving the function of a base even though not separately demarcated as such.

Sighting component 550, in this embodiment, comprises integral base 510 that in turn comprises base body 520, and front face 522, bottom 524, pin borings 525, rear face 526, and through borings 537 formed in base body 520. Integral base 510 may be made integrally with sighting component body 551, or as in this embodiment be bonded to sighting component body 551, for example using high-tack or permanent adhesives, welding, riveting, or other non-detachable meets. Front face 522 and rear face 526 preferably are configured, arrange, and oriented to be compatible and complementary with front wall 130 and back wall 150, respectively, thereby providing a substantially tight fit to help reduce translation and rotation of base 510 about sight receiver floor 140. Bottom 524 preferably is configured, arrange, and oriented to be compatible or complementary with sight receiver floor 140 to help reduce vibration of base 510 and mitigate any potential bending or warping of base 510. For example, in the depicted embodiment base 510 is substantially planar to interfit with substantially planar sight receiver floor 140. As discussed above with other embodiments, however, a front face, bottom, and/or rear face of a base may be configured, arrange, and/or oriented in other ways.

As depicted, pin borings 525 and through borings 537 are configured and arranged to be oriented substantially adjacent to pin holes 148 and tapped holes 146 of sight receiver 120, respectively. Preferably pin borings 525 and through borings 537 are substantially perpendicular to base body 520, but other orientations may be used, and in fact, may be preferable in different embodiments. In the depicted embodiment, through borings 537 continue the passage created in sighting component body 551 by through holes 554, which preferably are formed collinearly with through borings 537.

In this embodiment, sighting component 550 is attached to sight receiver 120 using screws 598, securing both sighting component 550 and its integral base 510. Two screws 598 are used, arranged laterally with one on each side of the longitudinal axis, but other embodiments may deploy a different quantity of screws and/or a different configuration, arrangement, and/or orientation of screws. For example, an embodiment may use four screws, for example arranged in a rectangular pattern on the base, or use three screws, for example arranged in a triangular pattern on the base. Screws 598 are disposed through holes 554 in sighting component body 551 and threaded into tapped holes 146.

This embodiment also uses pins 590 to stabilize the attachment of sighting component 550 to sight receiver 120, helping to mitigate translation and rotation of base 510 about sight receiver floor 140. Two pins 590 are used, arranged laterally with one on each side of the longitudinal axis, but other embodiments may deploy a different quantity of pins and/or a different configuration, arrangement, and/or orientation screws. For example, an embodiment may use four pins, for example arranged in a rectangular pattern on the base, or use three pins, for example arranged in a triangular pattern on the base. In this embodiment, each of pins 590 is dual-sized, with large-diameter end 591 disposed in a pin boring 525 and small-diameter end 592 disposed in a pin hole 148 when sighting component 550 is attached to sight receiver 120. Dual-sized cylindrical pins are used in this embodiment for the reasons discussed above with respect to pins 490, which will not be repeated here, but other embodiments may use alternatives as discussed above with respect to pins 490.

Sighting component body 551 as depicted comprises rear face 555 disposed at the longitudinal end of sighting component 550 opposite the muzzle or projectile ejection end of the projectile launching device. In this embodiment, rear face 555 comprises a generally planar surface having a normal substantially parallel to the longitudinal axis. Auxiliary sight mount 560 is configured in rear face 555. In this embodiment, auxiliary sight mount 560 comprises a rectangular channel oriented vertically along the vertical centerline of rear face 555. Each side of the channel comprises vertically-oriented groove 562 located at the bottom of the channel and forming flange 561 on rear face 555. Accordingly, the channel forming auxiliary sight mount 560 has a "T" shaped cross-section in a horizontal plane, as visible from above in FIGS. 25, 27A, and 27B. In this embodiment, flanges 561 and grooves 562 are substantially parallel and extend substantially vertically. Alternatively, other embodiments may deploy auxiliary sight mounts configured, arrange, and/or oriented in other ways, for example in a horizontal orientation, using a non-rectilinear channel or groove or flange or any combination thereof, using a channel having nonparallel flanges, and other configurations providing interfitting parts as a means for attaching a second sighting component to a first sighting component. In yet other embodiments, the second sighting component may simply be attached to the first sighting component using fasteners or similar attachment means.

Depicted sighting component 540 comprises body 542 and mounting base 545. Body 542 in turn comprises a grip enhancement 541 formed in this embodiment as a flute, a bottom surface 543 formed in this embodiment as substantially planar and oriented substantially parallelly with base bottom 524, and sighting notch 544.

Mounting base 545, in this embodiment, is disposed longitudinally to the front of body 542. In this embodiment, base 545 is formed integrally with body 542, but in other embodiments may be attachable to body 542 (for example using fasteners) or be non-detachably bonded to body 542 (for example using high-tack or permanent adhesives, or welding). Mounting base 545 as depicted is formed as a rectangular cuboid oriented with top and bottom surfaces disposed horizontally and side surfaces disposed vertically. A rectangular groove 547 is formed on each vertical side face adjacent to body 542, thus forming vertical flanges 546 on each side of mounting base 545. The flanges 546 are configured, arranged, and oriented to fit grooves 562 in sighting component 550 when second sighting component 540 is attached to first sighting component 550. Correspondingly, flanges 561 of sighting component 550 are configured, arranged, and oriented to fit grooves 547 in mounting base 545 when second sighting component 540 is attached to first sighting component 550. As discussed above with respect to auxiliary sight mount 560, different configurations, arrangements, and/or orientations of a mounting base may be used in different embodiments, but preferably the elements of the mounting base will be configured, arranged, and oriented to be compatible and complementary with the elements of the auxiliary sight mount, thus forming interfitting parts.

As shown, the mounting base 545 further comprises a rectangular front face oriented vertically and located on the end of mounting base 545 that is longitudinally opposite body 542. When sighting component 540 is attached to sighting component 550, rear face 555 is substantially parallel to the front face of mounting base 545. In this embodiment, the front face comprises channel 548 configured as a flute extending horizontally across the entire front face of mounting base 545. The depicted channel 548 comprises flare 549 at each end of channel 548, which has the form of a side of a truncated cone. Although channel 548 extends entirely across the front face of mounting base 545, other embodiments may be configured, arranged, and/or oriented in other ways. For example, an embodiment may comprise a channel disposed on one side of the face and a channel disposed on the other side of the face, each of which only extends partially across the face and does not meet the other. Alternatively, an embodiment may have no channel, but simply have two flares, one on each side of the face, for example having a conical surface, a frustoconical surface, or a frustoconical surface terminated in a partial spherical surface. In yet other embodiments, a boring may be used instead of a channel, with outer ends having countersink surfaces providing the flares. Other, less preferred, embodiments may have no flares or bevel set screw ends, or both, and simply rely on the lateral forces of the set screws against the mounting base to restrain movement of the mounting base in the sighting component. Manufacturing economy and efficiency may play a role in the selection of the particular configuration, arrangement, and/or orientation of flares and channels, provided the selection serves as a sufficient means for attaching sighting component 540 to sighting component 550, as described in more detail below.

In this embodiment, second sighting component 540 is attached to first sighting component 550 using auxiliary sight mount 560 and mounting base 545. Because the pairs of grooves 547 and flanges 561 and the pairs of grooves 562 and flanges 546 are configured as interfitting parts, when each of those pairs are correctly engaged, sighting component 540 may slide vertically down the back of sighting component 550 adjacent to rear face 555. The engagement of grooves 547 with flanges 561 and the engagement of grooves 562 with flanges 546 substantially limits lateral and longitudinal displacement of sighting component 540 and rotation of sighting component 540 around the longitudinal and lateral directions. Machining tolerances combined with the preference for easy detachability of sighting component 540, however, prevent the elimination of all translation and rotation of sighting component 540 by grooves 547, flanges 561, grooves 562, and flanges 546 alone.

To enhance the attachment and stabilization of sighting component 540 with sighting component 550, this embodiment uses set screws 563 disposed in tapped holes 566. A set screw 563 and its corresponding tapped hole 566 are disposed on each side of body 551, with tapped hole 566 oriented horizontally in a lateral direction, preferably orthogonally, and with each tapped hole 566 being collinear. In a preferred method of attaching sighting component 540 to sighting component 550, mounting base 545 slides down rear face 555 while engaged with auxiliary sight mount 560 until bottom surface 543 contacts second rear sight receiver floor 160. Then, set screws 563 are threaded into holes 565 until set screw beveled ends 564 engage flares 549. Preferably, in this position the centerline of channel 548 is slightly above and slightly forward (longitudinally) the collinear central axes of holes 565. Accordingly, as set screws 563 are tightened, beveled ends 564 exert forces having downward vertical components on the lower portions of channel flares 549 and rearward (longitudinally) components on the side portions of channel flares 549. The downward force components tighten the interface of bottom surface 543 against second rear sight receiver floor 160, and the rearward force components tighten the engagement of the inner sides of flanges 546 against the corresponding inner sides of flanges 561. Alternatively, in other embodiments, set screws, set screw holes, and flarings may be configured, arranged, and/or oriented to impose only a longitudinal force, only a vertical force, or no longitudinal and vertical force (in which case the beveled ends of the set screws engage the flares to simply resist relative vertical movement of the sighting components). In the depicted embodiment, however, set screws 563 with beveled ends 564 operate together with compatible and complementary flares 549 as a means to urge bottom surface 543 and floor 160 together tightly, and to urge flanges 546 and flanges 561 together tightly.

If mounting base 545 is made of a soft material, such as aluminum, strong tightening of set screws 563 may somewhat deform flanges 546, perhaps making removal of second sighting component 540 difficult. Accordingly, grip enhancements 541 are provided in this embodiment to aide with detachment of sighting component 540 from sighting component 550. As shown, each grip enhancement 541 comprises a single flute oriented horizontally across a lateral side of body 542, and thus oriented longitudinally. Optionally, one or more additional flutes may be provided, for example oriented parallel to grip enhancement 541. In other embodiments, grip enhancements may be formed in different configurations, arrangements, and/or orientations. For example, a grip enhancement may be formed as one or more grooves having triangular or rectangular cross-sections, or may be formed as a knurling or a checkering.

FIGS. 30-34 depict an embodiment comprising base 610 configured with adjustable open iron sight 640. In this embodiment, base body 620 comprises front face 622, bottom surface 624, rear face 626, juts 630, bevel surface 632, intersection line 633, tenon 634, borings 637, and screws 695. The description provided above with respect to the embodiment of FIGS. 15-19 regarding front face 322, first bottom surface 324, rear face 326, juts 330, bevel surface 332, intersection line 333, tenon 334, borings 337, and screws 395, and the fastening and stabilization of base 310 with rear sight receiver 120 apply fully to front face 622, bottom surface 624, rear face 626, juts 630, bevel surface 632, intersection line 633, tenon 634, borings 637, screws 695, and the fastening and stabilization of base 610 with rear sight receiver 120, and will not be repeated, except to note that in this embodiment also, tenon 634 and mortise 144 are interfitting structures forming means to at least partially restrain or retain base 610 and sight receiver 210 in longitudinal alignment and lateral alignment when assembled together, with tenon 634 and mortise 144 being longitudinally oriented.

In this embodiment, channel 635 extends around tenon 634. The bottom of channel 635 is substantially planar and parallel to bottom surface 624 and the lower surface of tenon 634, which also are substantially planar and parallel. Channel 635 provides several advantages in this embodiment, and may provide one or more similar advantages in other embodiments including the other embodiments described in this disclosure. For example, if the manufacture of base 610 is performed using machine tool, forming channel 635 during the formation of tenon 634 may help avoid tool marks on bottom surface 624, resulting in a flatter, more consistent surface of bottom surface 624. In addition, channel 635 removes material from and thus lightens base 610. A lighter base 610 may be advantageous in various applications, including such as placement of base 610 on a reciprocating component such a slide 100. In addition, using channel 635 may reduce vibration of base 610, which may be enhanced by packing channel 635 with grease, foam, caulk, or other elastomeric compound prior to attaching base body 620 to rear sight receiver 120.

Sighting component 640 is adjustable in this embodiment, allowing adjustment of both elevation and windage of sighting notch 644. Sighting component 640 comprises leaf 641, body 642, leaf pins 643, sighting notch 644, leaf screw 645, spring 646, tapped boring 647, windage block 648, and windage adjustment screw 649. Base body 620 may also be considered to be part of sighting component 640, in which case the base will be considered as integral with the sighting component such as in the embodiment depicted in FIGS. 25-29.

Figure 32A:
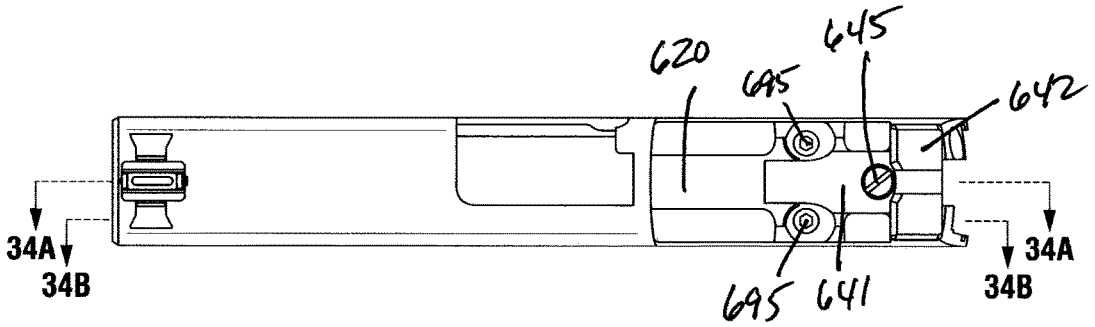
FIG. 32A is a plan view of the integrally formed base and sighting component depicted in FIG. 30.
Figure 32B:
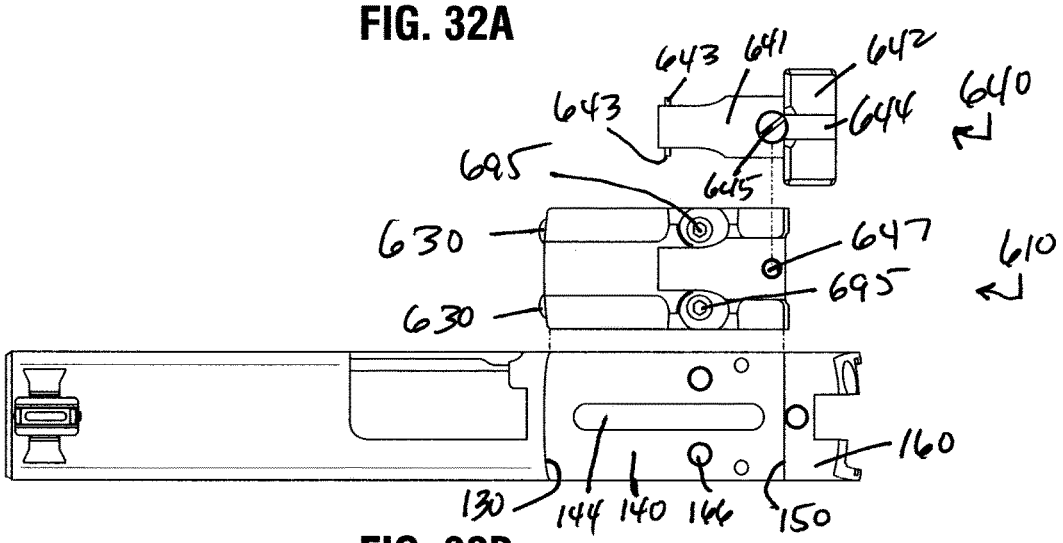
FIG. 32B is a plan view of the integrally formed base and sighting component depicted in FIG. 30.
Figure 33A:
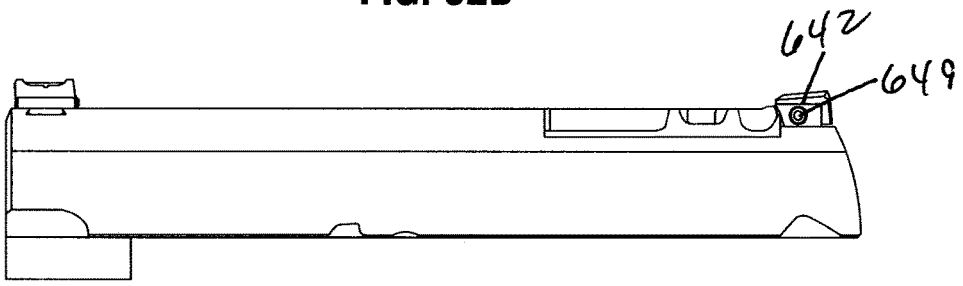
FIG. 33A is an elevation view of the integrally formed base and sighting component depicted in FIG. 30.
Figure 33B:
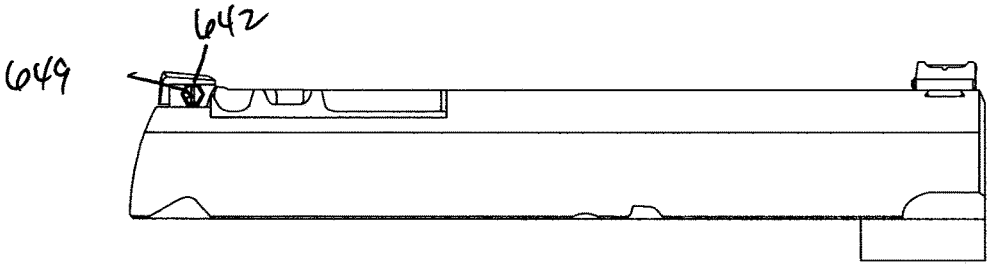
FIG. 33B is an elevation view of the integrally formed base and sighting component depicted in FIG. 30.
Figure 33C:
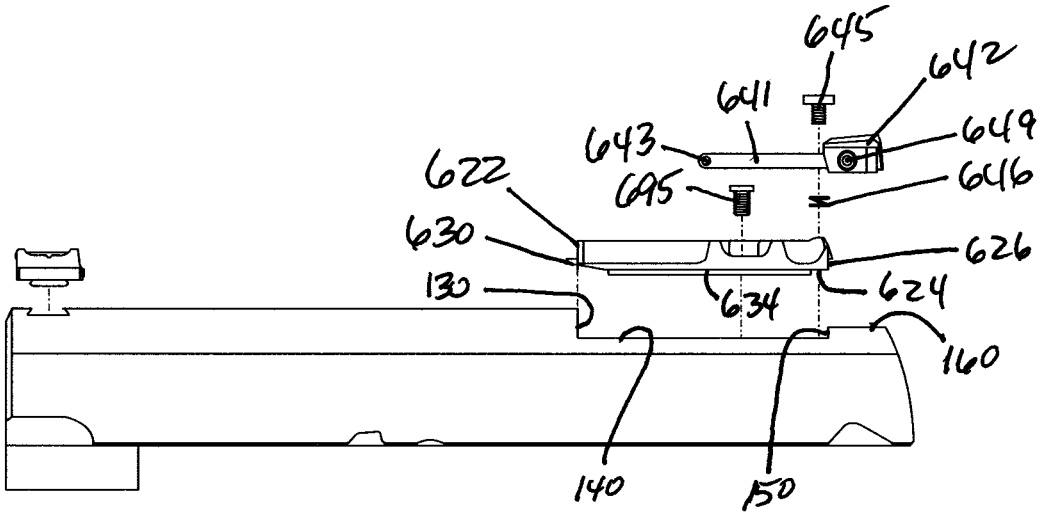
FIG. 33C is an elevation view of the integrally formed base and sighting component depicted in FIG. 30.
Figure 34A:
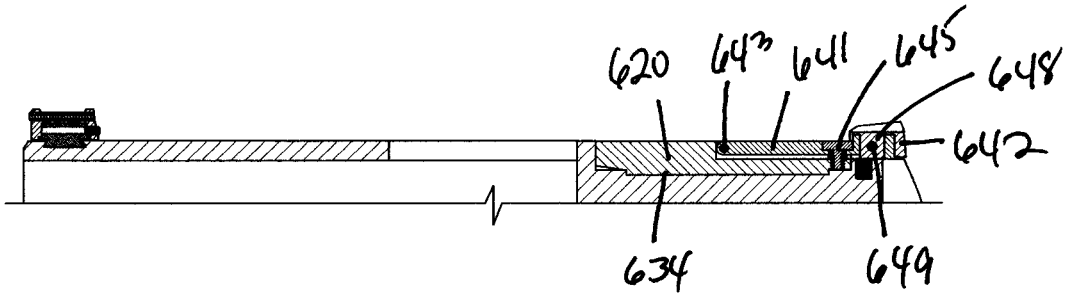
FIG. 34A is a section view of the integrally formed base and sighting component depicted in FIG. 30 taken upon section plane 34A-34A indicated on FIG. 32A.
Figure 34B:
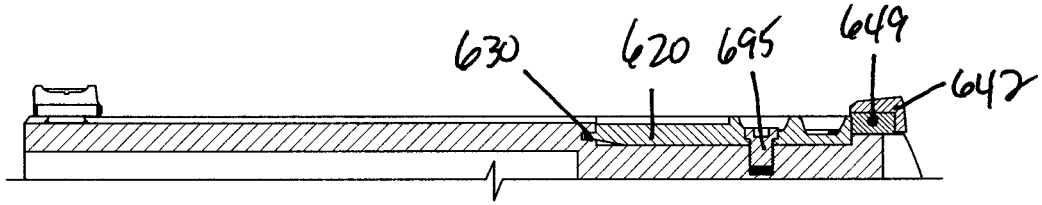
FIG. 34B is a section view of the integrally formed base and sighting component depicted in FIG. 30 taken upon section plane 34B-34B indicated on FIG. 32A.
Figure 35:
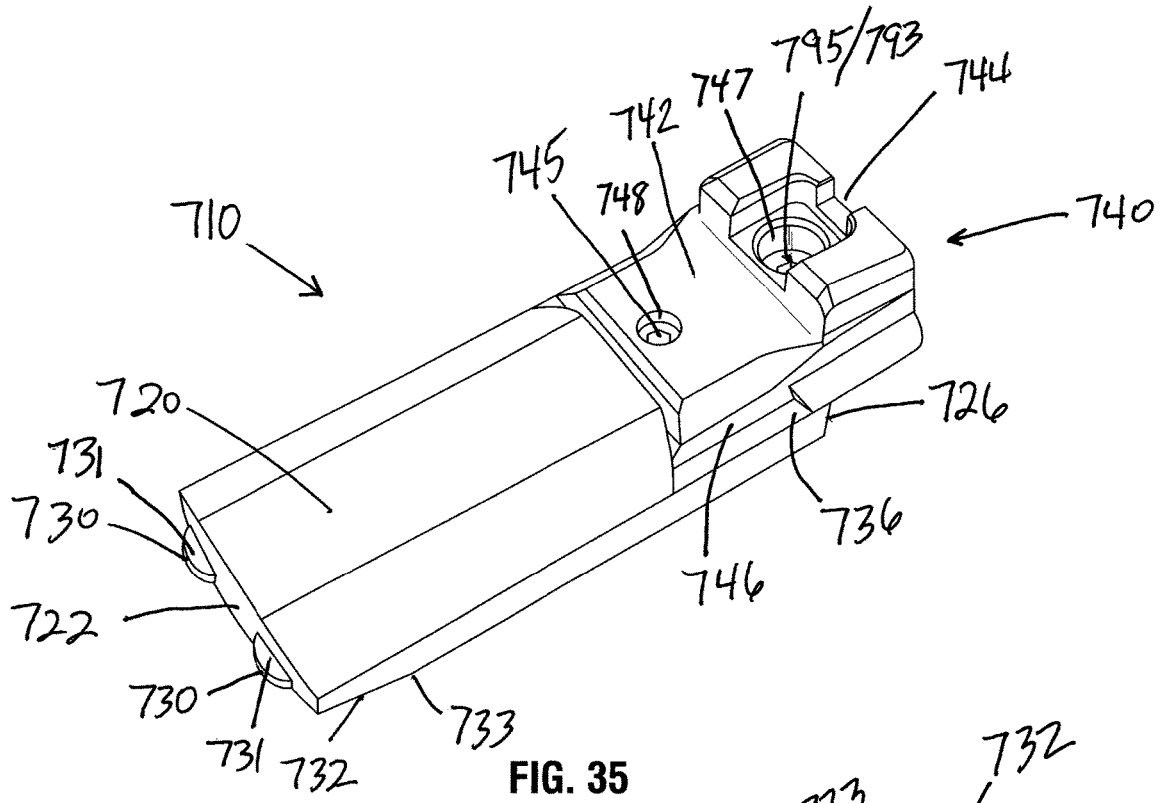
FIG. 35 is a perspective view of a base and sighting component in one embodiment.
Figure 36:
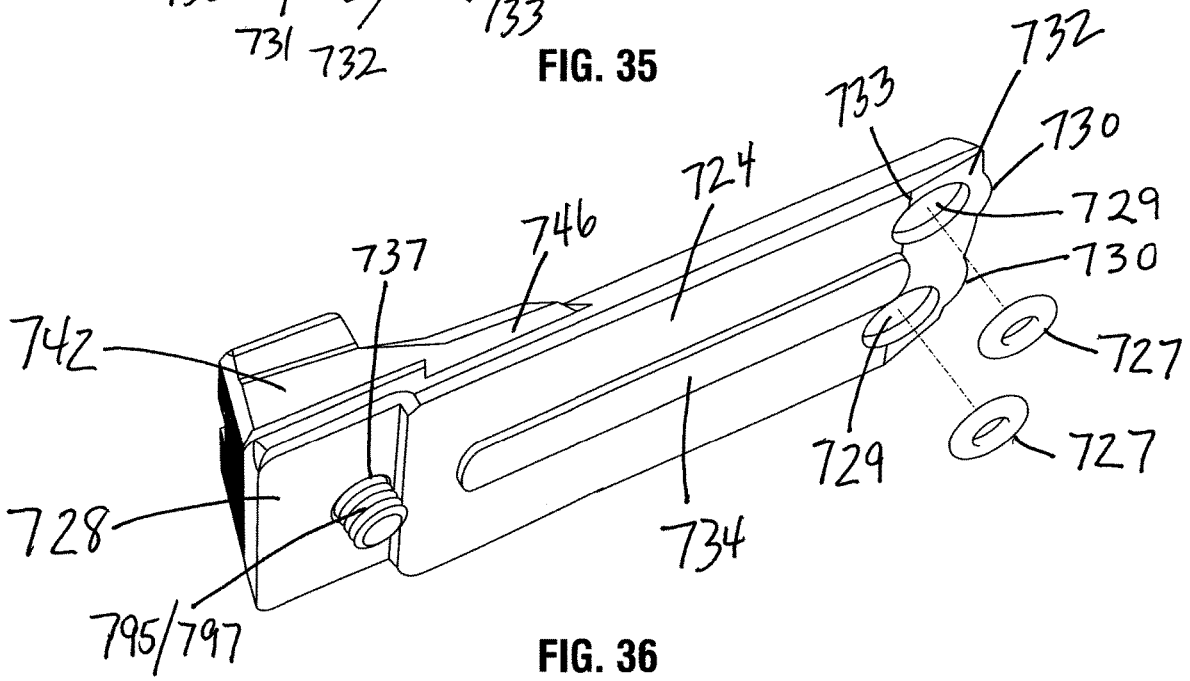
FIG. 36 is a perspective view of the base and sighting component depicted in FIG. 35.
Figure 37A:
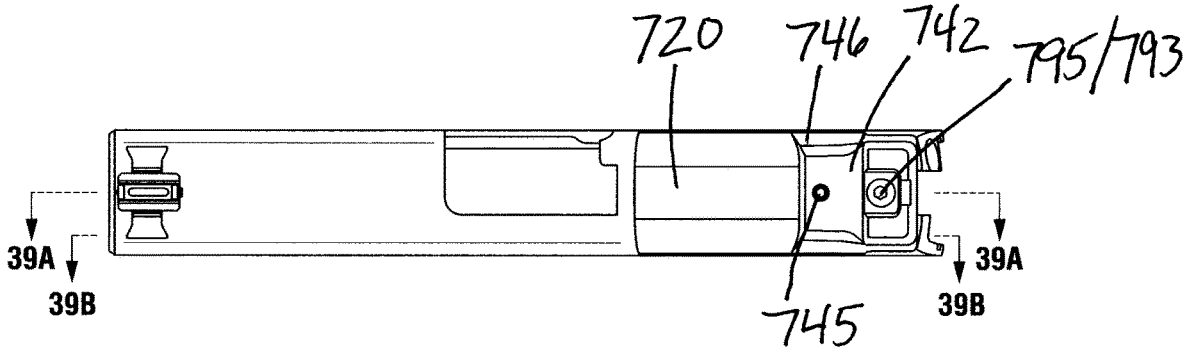
FIG. 37A is a plan view of the base and sighting component depicted in FIG. 35.
Figure 37B:
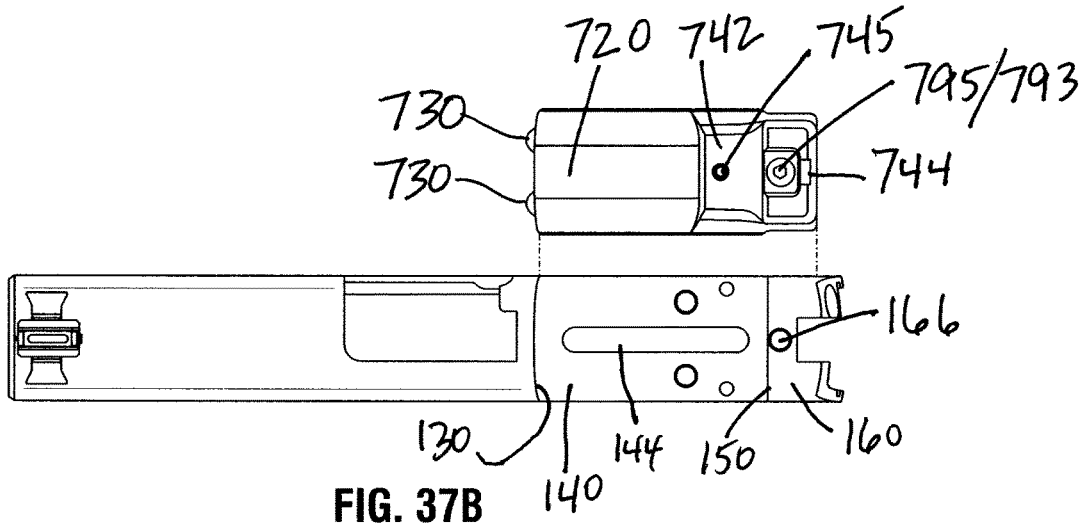
FIG. 37B is a plan view of the base and sighting component depicted in FIG. 35.

In this embodiment, leaf 641 is elongated in the longitudinal direction and is formed with substantially flat upper and lower surfaces. As shown in FIGS. 32B, 33C, and 34A, leaf pins 643 are located at the front longitudinal end of leaf 641, and sighting component body 642 is located at the rear longitudinal end of leaf 641. As shown, leaf pins 643 are disposed horizontally and orthogonal to the longitudinal direction. Leaf pins 643 may comprise a separate pin on each side of leaf 641, or the exposed ends of a single pin disposed in a boring in the end of leaf 641. Leaf pins 643 extend into recesses in base body 620, so that each of leaf pins 643 has one end located in base body 620 and the other end located in leaf 641. One end of leaf pins 643 is press fit or bonded to either of leaf 641 or base body 620, but not both. Accordingly, the interfitting of leaf pins 643 with leaf 641 and base body 620 forms a hinge allowing leaf 641 to rotate in a plane extending longitudinally and vertically. Rotating leaf 641 about leaf pins 643 raises or lowers body 642 and its sighting notch 644 relative to the longitudinal axis. Consequently, the angle between the projectile ejection direction and the sight line extending through sighting notch 644 and the sighting reference point of front sighting component 250 (e.g., the center of optical fiber 271 or the top of blade 270, depending on operator preferences) to the target may be adjusted. By adjusting this angle, the trajectory of the ejected projectile may be accommodated so that the sight line terminates at the intended point of impact at the selected distance. Elevation adjustment in the depicted embodiment is accomplished by rotating threaded leaf screw 645 in threaded boring 647, which are located between leaf pins 643 and body 642 when leaf 641 is installed in base body 620. The rotation of threaded leaf screw 645 in threaded boring 647 raises or lowers the head of leaf screw 645 relative to base body 620. Leaf 641 is biased against the underside of leaf screw 645 by spring 646. By raising or lowering the head of leaf screw 645, sighting notch 644 is raised or lowered relative to body 640.

Windage adjustments are accomplished in this embodiment by lateral movement of body 642 and sighting notch 644. As shown, body 642 comprises windage block 648, which extends into a lateral slot at the end of leaf 641. Windage block 648 comprises a threaded boring that extends laterally. Windage screw 649 extends laterally through the slot and through the threaded boring of windage block 648, and is captured to prevent movements with respect to leaf 641 except rotation about the longitudinal axis of windage screw 649. Accordingly, by rotating windage adjustment screw 649 in one direction, block 648 on body 642 and sighting notch 644 on body 642 are moved laterally in one direction, and by rotating windage adjustment screw 649 in the other direction, block 648 on body 642 and sighting notch 644 on body 642 are moved laterally in the other direction. In this way, sighting notch 644 may be moved laterally with respect to front sight blade 270, allowing the projectile launching device operator to compensate for wind effects on the trajectory of an ejected projectile.

FIGS. 35-39 depict an embodiment in which the sighting component is mounted low relative to the base and sight receiver. Such low-profile sights are sometimes preferred. For example, a pistol used for personal defense may be equipped with low-profile sights to avoid snagging of sight components with clothing when the pistol is drawn from a holster or pocket. In other situations, low-profile sights may be preferred to keep the sight line low and close to the projectile ejection direction.

As depicted in FIGS. 35-39, the sighting system comprises base 710 and sighting component 740. Base 710 comprises base body 720, front face 722, first bottom surface 724, rear face 726, second bottom surface 728, juts 730, bevel surface 732, intersection line 733, tenon 734, and dovetail slot 736. The description provided above with respect to the embodiment of FIGS. 15-19 regarding front face 322, first bottom surface 324, rear face 326, second bottom surface 328, juts 330, bevel surface 332, intersection line 333, tenon 334, dovetail slot 336, and the fastening and stabilization of base 310 with rear sight receiver 120, apply fully to front face 722, first bottom surface 724, rear face 726, second bottom surface 728, juts 730, bevel surface 732, intersection line 733, tenon 734, dovetail slot 736, and the fastening and stabilization of base 710 with rear sight receiver 120, and will not be repeated, except to note that in this embodiment also, tenon 734 and mortise 144 are interfitting structures forming means to at least partially restrain or retain base 710 and sight receiver 210 in longitudinal alignment and lateral alignment when assembled together, with tenon 734 and mortise 144 being longitudinally oriented.

In this embodiment, sighting component 740 comprises body 742, sighting notch 744 disposed on body 742, dovetail key 746, through hole 747, set screw 745, and set screw tapped hole 748. As shown best in FIGS. 38 and 39, body 742 generally may be considered as having two main sections, the portion comprising dovetail key 746 disposed on the longitudinally front end of body 742, and the portion comprising notch 744 disposed on the longitudinally rear end of body 742.

As shown, sighting component 740 is attached to base 720 by means of interfitting dovetail key 746 and dovetail slot 736. In addition, once sighting component 740 has been positioned correctly in base 720, attachment is enhanced by tightening set screw 745 in tapped hole 748, causing the end of set screw head 745 to exert a downward against the floor of dovetail slot 736, with resultant upward forces of the edges of dovetail key 746 against the edges of dovetail slot 736. Preferably, attachment of sighting component 740 to base 720 is enhanced by using a releasable adhesive in slot 736.

Figure 39A:
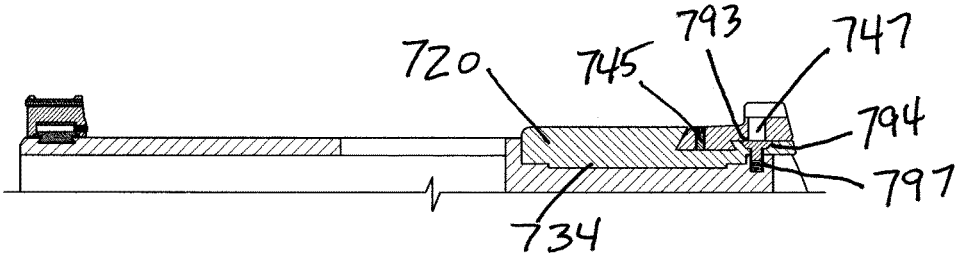
FIG. 39A is a section view of the base and sighting component depicted in FIG. 35 taken upon section plane 39A-39A indicated on FIG. 37A.
Figure 39B:
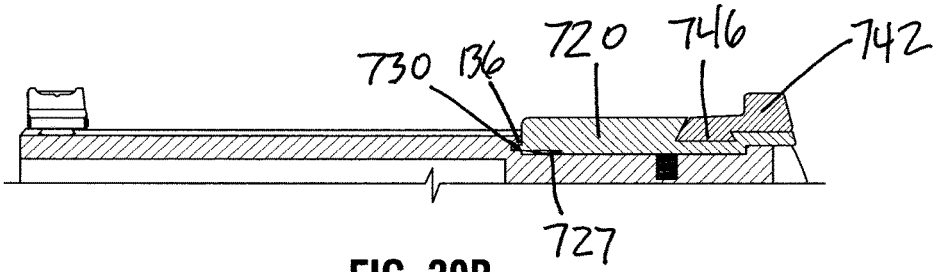
FIG. 39B is a section view of the base and sighting component depicted in FIG. 35 taken upon section plane 39B-39B indicated on FIG. 37A.
Figure 40:
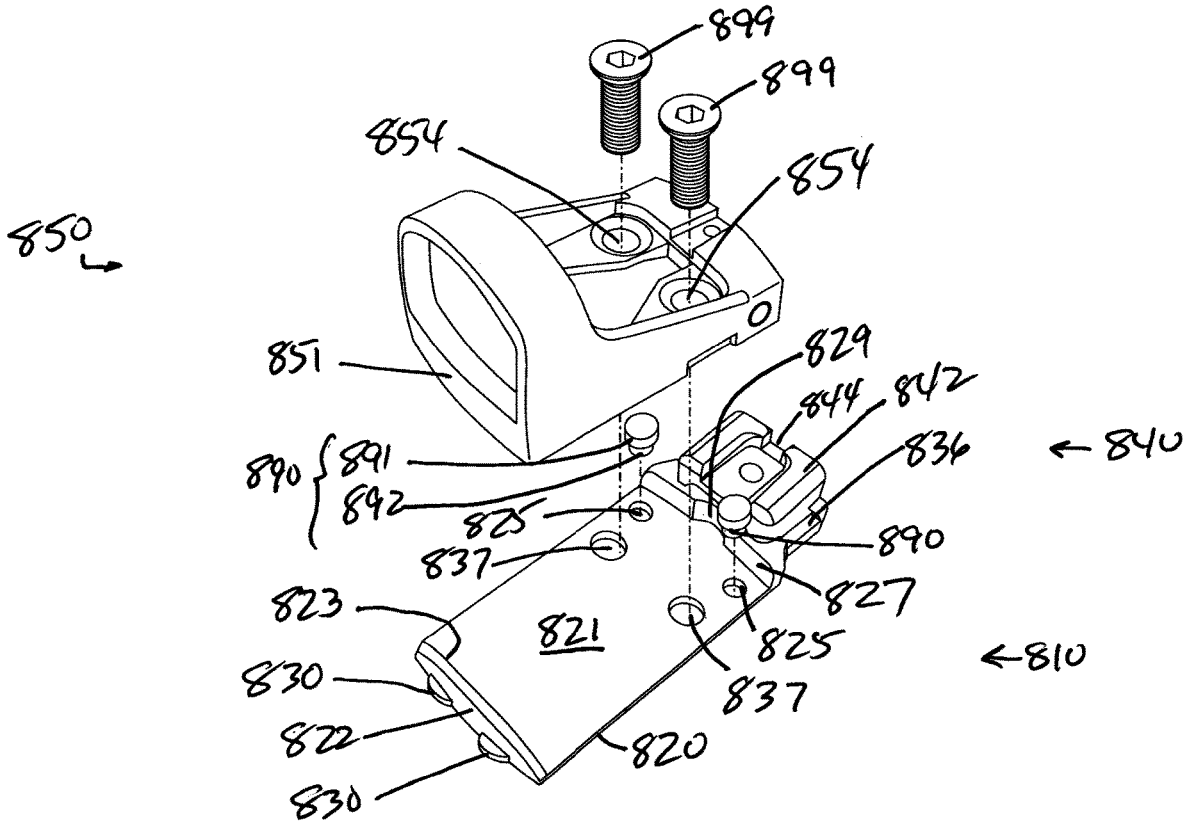
FIG. 40 is a perspective view of a base and sighting component in one embodiment.
Figure 41:
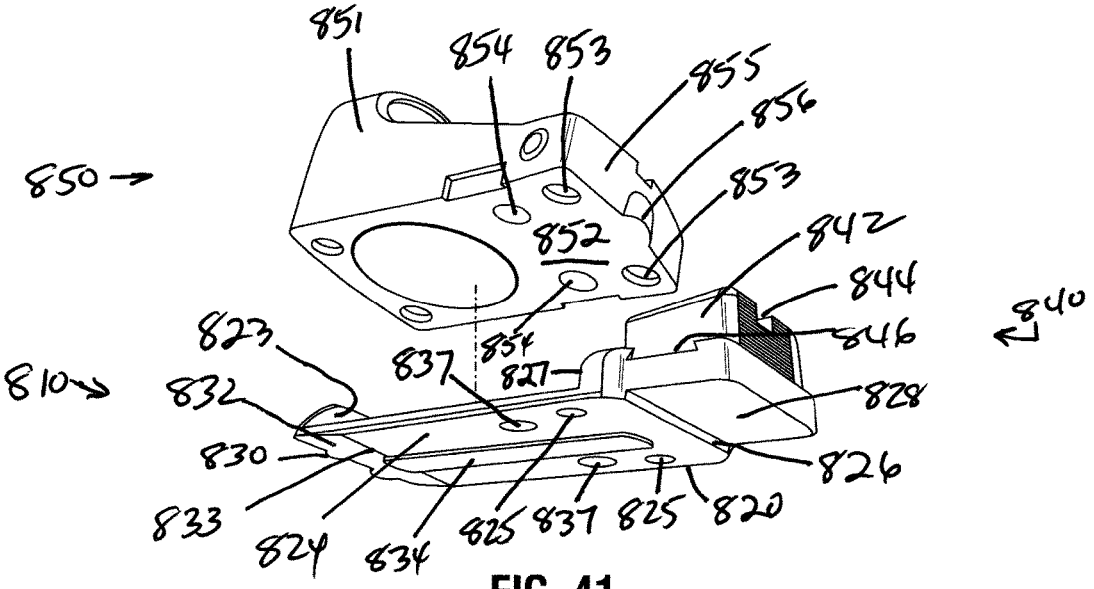
FIG. 41 is a perspective view of the base and sighting component depicted in FIG. 40.
Figure 42A:
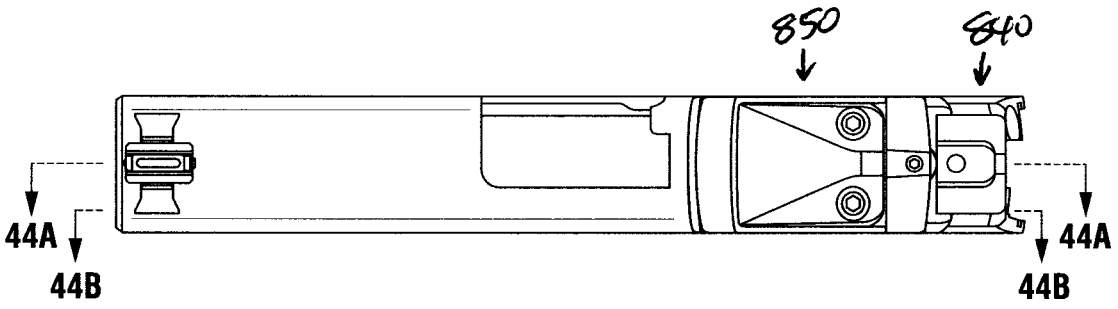
FIG. 42A is a plan view of the base and sighting component depicted in FIG. 40.
Figure 42B:
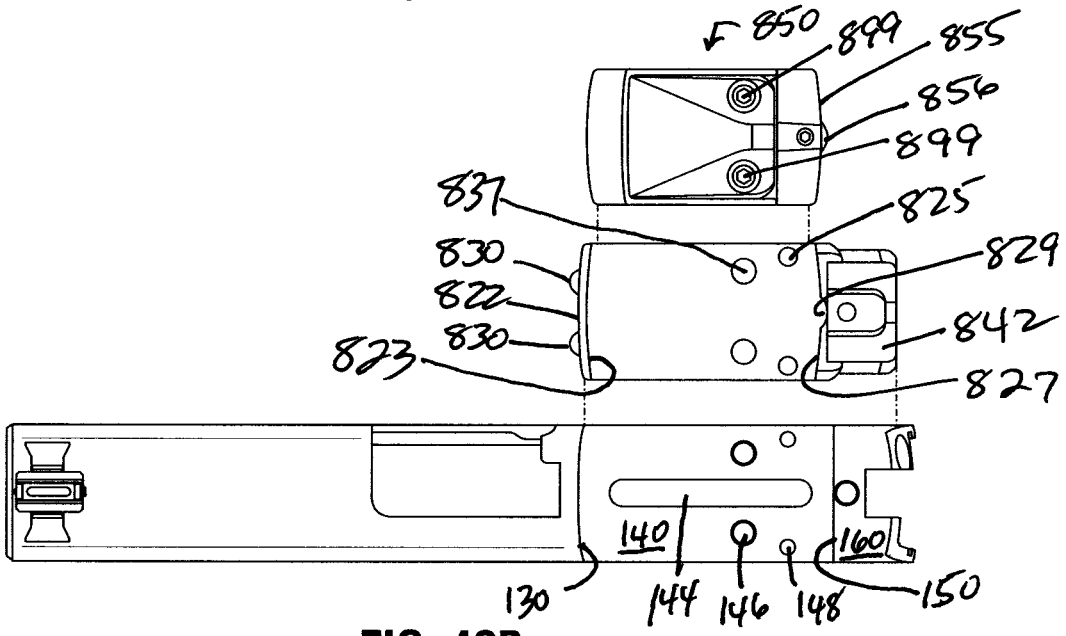
FIG. 42B is a plan view of the base and sighting component depicted in FIG. 40.
Figure 43A:
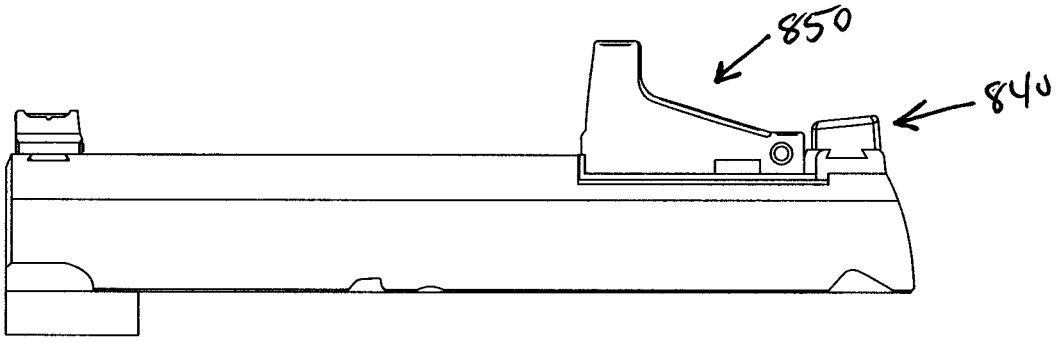
FIG. 43A is an elevation view of the base and sighting component depicted in FIG. 40.
Figure 43B:
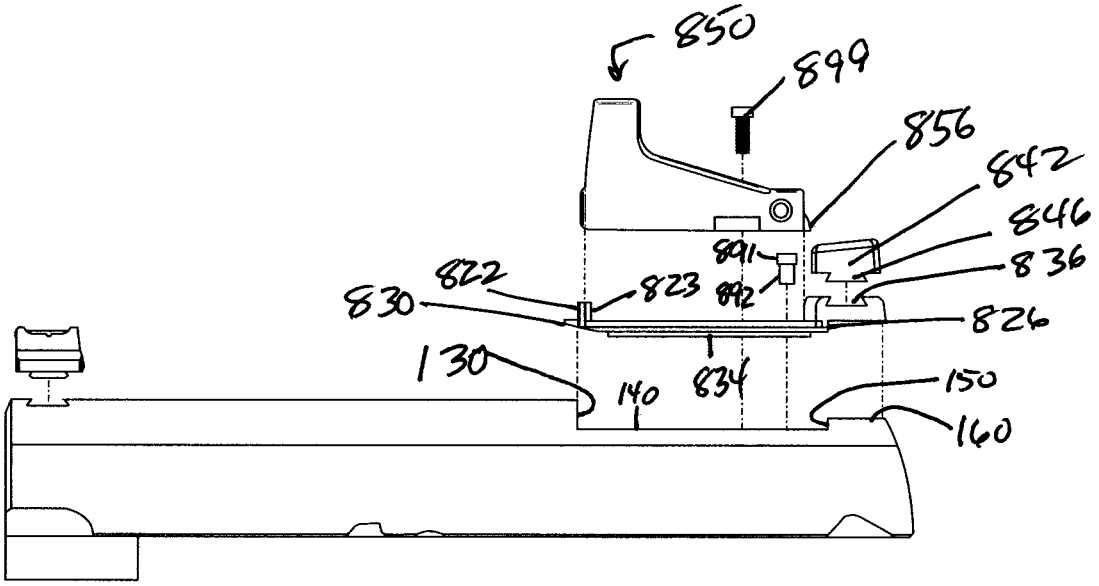
FIG. 43B is an elevation view of the base and sighting component depicted in FIG. 40.

Dovetail slot 736 is disposed deep into body 720, compared to the disposition of dovetail slots 336 and 446 into sight bodies 320 and 420, respectively, as depicted in FIGS. 18, 19, 23, and 24. In addition, as shown dovetail slot 736 is disposed more forward on body 720, compared to the disposition of dovetail slot 336 on body 320 and the disposition of dovetail slot 436 on body 420. The forward placement puts dovetail slot 736 over first rear sight receiver floor 140, which is deeper into slide 100 than second rear sight receiver floor 160, over which dovetail slots 336 and 446 are disposed. It is generally preferable to have the front and rear sights separated as far as reasonably possible, so as to provide the longest sight radius as reasonably possible, providing better sighting accuracy. By positioning dovetail slot 736 forward over first rear sight receiver floor 140, slot 736 may be lower in body 720 yet still have sufficient supporting material of base 720 below dovetail slot 736. Extending body 720 rearward of slot 736, as shown, then allows sighting notch 744 to be almost level with the top of body 720, as best seen in FIG. 39A, yet still as far back along slide 100 as reasonably possible.

In this embodiment, attachment of base 710 to rear sight receiver 120 may generally proceed substantially as discussed above with respect to the embodiment of FIGS. 15-19. For example, the assembly method may include the step of applying a downward force to the end of base body 720 opposite juts 730 to impose a rotation of base body 720 about intersection line 733, until second bottom surface 728 contacts second rear sight receiver floor 160, thus causing the tops 136 of slots 135 to impose a downward force against the tops 731 of juts 730. In this method, the downward forces exerted on the longitudinally rear end of base body 720 and the downward forces exerted by slot tops 136 and jut tops 731 both impose moments about intersection line 733, with resulting stresses and strains imposed in base body 720 that enhance the attachment and stabilization of base body 720 with rear sight receiver 120. As with the method discussed above with respect to the embodiment of FIGS. 15-19, the difference in the height of slot tops 136 and the height of jut tops 731 preferably are calibrated to the modulus of elasticity of base body 720, with a material having a higher modulus requiring less height difference compared to a material having a lower modulus. In addition, the difference in heights may be reduced or even eliminated by the use of an elastomeric or otherwise resilient mounting pad on bottom surface 724, for example as discussed below.

In embodiments where body 720 is made of aluminum or other material with a lower modulus of elasticity, the use of elastomeric or otherwise resilient mounting pads is preferred. When body 720 of the embodiment depicted in FIGS. 35-39 is made of aluminum, therefore, it is preferred to use elastomeric mounting pads 727, disposed in pad recesses 729 located near the longitudinal front of bottom surface 724. In this embodiment, elastomeric mounting pads 727 comprise rubber O-rings, which are disposed in cylindrical recesses 729. One recess 729 and its associated mounting pad 727 are located on each lateral side of bottom surface 724, as shown. The use of elastomeric or otherwise resilient mounting pads 727 enhances the stability of the attachment of base 710 to sight receiver 120 in embodiments where the difference in heights of tops 731 and tops 136 is reduced or eliminated to reduce stresses and strains imposed in body 720 by the rotation of body 720 about intersection line 733 into final assembled position. With this arrangement and configuration, elastomeric or otherwise resilient mounting pads 727 will cause jut tops 731 to impose an upward force on slot tops 136 without (or with reduced) imposed moments resulting from the rotation of body 720 about intersection line 733. In other embodiments, elastomeric or otherwise resilient mounting pads may be configured, arranged, and/or oriented in other ways. For example, mounting pads may be made of thermoplastic, and arranged in pairs on each corner of body 720. Alternatively, one or more elastomeric or otherwise resilient mounting pads may be sized to fit in the bottom of mortise 144 and exert upward pressure on the bottom of tenon 734.

During assembly of the depicted embodiment, following rotation of base body 720 about intersection line 733 until second rear bottom surface 728 abuts second rear sight receiver floor 160, the longitudinal rear end of base 710 is attached to sight receiver 120 by a single screw 795. As shown, screw 795 comprises a head comprising flat circular top 793, frustoconical side 794, base surface 796, and threaded shank 797. As shown base surface 796 is substantially planar and oriented substantially parallel to top 793 and substantially orthogonal to the central axis of threaded shank 797. Base body 720 comprises a through boring 737, comprising an upper inner surface having countersink portion 735 compatible and complementary with frustoconical side 794, planar shoulder portion 738 compatible with planar base surface 796, and shank portion 739 sized to accept shank 748 without interference. With base body 720 in final position, screw 795 is inserted into boring 737 until threaded shank 797 first engages the threads of tapped hole 166, and then rotated to thread shank 797 into hole 166 until base surface 796 contacts shoulder portion 738 and side surface 794 contacts countersink portion 735. Screw 795 is then tightened to specification. When screw 795 is tightened, the contact of base surface 796 with shoulder portion 738 enhances vertical force applied downward against body 720, while still allowing the contact of frustoconical head side surface 794 with countersink portion 735 to exert even radially directed forces to enhance lateral and longitudinal stabilization of the attachment of base 710 to sight receiver 120.

In this embodiment, when screw 795 is tightened to specification, screw top surface 793 is below the top surface of base 720, allowing clearance for sighting component 740 to slide laterally in dovetail slot 736 without interference with screw 795. When sighting component 740 is attached in final position, the driving means of screw 795 disposed on top surface 793 may be accessed through hole 747 for attachment or detachment of base 710 to sight receiver 120. Preferably, the diameter of the through hole 747 is smaller than the outer diameter of the head top surface 793. In that way, screw 795 becomes captured in boring 737 but still operable through hole 747. By capturing screw 795 in boring 737, use of this embodiment in a sight system having multiple, interchangeable sighting components becomes more convenient because screw 795 will not be lost or misplaced during interchange.

This embodiment has an additional benefit of partially hiding the head of screw 795 by using a smaller boring 747 to access the drive means of screw 795. In this embodiment, the head of screw 795 is somewhat further hidden by having access hole 747 recessed and disposed in the area created by the protrusions forming sighting notch 744. As screw 795 is the only operable means of attaching base 710 to sight receiver 120, the aesthetics of base 710 will be improved for projectile launching device operators that prefer an appearance uncluttered by exposed fasteners.

FIGS. 40-44 depict another embodiment comprising plural sighting components. In this embodiment, first sighting component 850 is a reflex sight, and second sighting component 840 is a fixed, open iron sight.

Base body 820 of this embodiment further comprises front face 822, first bottom surface 824, rear face 826, second bottom surface 828, juts 830, bevel surface 832, intersection line 833, tenon 834, dovetail slot 836, second sighting component 840, second sighting component body 842, sighting notch 844, and dovetail key 846. The description provided above with respect to the embodiment of FIGS. 15-19 regarding front face 322, first bottom surface 324, rear face 326, second bottom surface 328, juts 330, bevel surface 332, intersection line 333, tenon 334, dovetail slot 336, sighting component 340, sighting component body 342, sighting notch 344, dovetail key 346. and the fastening and stabilization of base 310 with rear sight receiver 120, apply fully to front face 822, first bottom surface 824, rear face 826, second bottom surface 828, juts 830, bevel surface 832, intersection line 833, tenon 834, dovetail slot 836, second sighting component 840, second sighting component body 842, sighting notch 844, dovetail key 846, and the fastening and stabilization of base 810 with rear sight receiver 120, and will not be repeated, except to note that in this embodiment also, tenon 834 and mortise 144 are interfitting structures forming means to at least partially restrain or retain base 810 and sight receiver 210 in longitudinal alignment and lateral alignment when assembled together, with tenon 834 and mortise 144 being longitudinally oriented.

As depicted, sighting component 850 comprises body 851, bottom surface 852, pin hole 853, through hole 854, rear face 855, and rear face protrusion 856. This bottom surface 852 preferably is substantially planar with a normal substantially vertical when sighting component 850 is attached to sight receiver 120. Bottom surface 852 comprises blind pinholes 853 configured to receive large end 891 of pin 890. Body 851 comprises through holes 852 extending completely through body 851 and oriented substantially vertically, configured to receive screws 899 attaching sighting component 850 and base 810 to sight receiver 120.

In this embodiment, base body 820 further comprises top surface 821, top front internal face 823, top rear internal face 827, and top rear internal face recess 829. Preferably, top surface 821, rear face 827, recess 829, and front face 823 are configured, arranged, and oriented to be compatible and complementary, respectively, to bottom surface 852, rear face 855, rear face protrusion 856, and the front lower portion of sighting component body 851. Thus, these structures become interfitting parts, and may substantially reduce translations and rotations of sighting component 850 with respect to base body 820. That reduction of translations and rotations helps enhance the attachment and stability of sighting component 850 when installed on base body 820. The depicted configuration, arrangement, and orientation of these elements is preferred, but other embodiments may use different configurations, arrangements, and orientations.

A pair of screws 899 are used in this embodiment to attach sighting component 850 and base body 820 to sight receiver 120, passing through holes 854 in sighting component 850 and borings 837 in base body 820. In addition, attachment and stabilization of sighting component 850 to base body 820, and base body 820 to sight receiver 120, are enhanced by the use of two dual-sized pins 890. Preferably, pin borings 825, pin holes 853, and pin holes 148 are substantially cylindrical, are substantially normal to sight receiver floor 140 and base surfaces 821 and 824, and are substantially collinear when sighting component 850 is attached to base 810 and base 810 is attached to sight receiver 120. In this embodiment, the ends 891 of pins 890 configured for insertion in pin holes 853 have a diameter larger than the diameter of the ends 892 of pins 890 configured for insertion in pin borings 825 and pin hole 148. In each pin 890, the transition between the two sizes forms a planar disk supported on top surface 821 of base body 820 when that pin is inserted in base top surface 821, for example as shown in FIGS. 23B, 24B, 40, 43B, and 44B and the described above with respect to the embodiments depicted therein.

The use of dual sized pins is optional, but in this embodiment and others may enhance the restraint of sighting component 850 against translation and rotation about base top surface 821 by providing a flat surface at the transition in size between ends 891 and 892 that rests on flat base top surface 821, thus reducing tilting of pin 890 that might otherwise result from slight differences in the diameters of pin ends 892 and pin borings 825 that may result from even relatively tight manufacturing tolerances.

The additional advantages of dual-sized pins and the various alternative embodiments discussed above with respect to the embodiment of FIGS. 20-24, its pins 490, and its associated pin holes and borings, fully applies to this embodiment, and will not be repeated here. It is noted, however, that the use of dual sided pins that extend into both the sighting component and the base and continue into the sight receiver may provide greater attachment and stability than pins engaging only two parts of the system.

A full sighting system comprising multiple interchangeable individual sighting systems, for example some or all of the sighting component embodiments described in this disclosure, may enhance the utility of a projectile launching device. Preferably, interchanging individual sighting systems on a projectile launching device will be facilitated by using as few fasteners as possible, thus simplifying the interchange of components. For example, the individual sighting system embodiments described in this disclosure require no more than two fasteners to attach and detach the sighting system to the sight receiver. By providing both front and rear interchangeable sight systems, a wider variety of individual sighting components may be used in the full sighting system. To improve aesthetics in a sight system comprising multiple interchangeable individual sighting systems, aesthetics may be improved by contouring the outer surfaces of each of the sight bases to match the outer surfaces of the projectile launching device proximate to the sight receiver.

A full sighting system comprising multiple interchangeable individual sighting systems may be deployed, for example using all of the sighting component embodiments described in this disclosure. In a preferred way of producing such a full sighting system, the main sighting component is selected from the group of individual sighting systems to be deployed. A preferred way of selecting the main sighting component is to choose the sighting component with the largest footprint and/or with other advantageous features, such as a means for mounting an additional sighting component. For example, sighting component 550 has as large or a larger footprint than the other sighting components described in this disclosure, and also has means for mounting second sighting component 540. In this example, that selection is depicted in FIGS. 25-29. Preferably the sight receiver will be configured directly into a frame, receiver, or slide, to be compatible and complementary with the lower portion of the selected main sighting component, which lower portion then serves as an integrally formed base, for example as depicted in FIGS. 25-29. Alternatively, a separate base may be configured to be complementary and compatible with the sight receiver and with the selected main sighting component, but using the lower portion of the main sighting component as an integral base and attaching the main sighting component directly to the sight receiver typically will present the sighting elements of the main sighting component closer to the frame, receiver, or slide, which typically will be advantageous for at least having the sighting line closer to the path at which a projectile is ejected from the projectile launching device.

In this example, after selecting the main sighting component and configuring a sight receiver for attachment of the main sighting component (either directly or indirectly using a separate base), the other individual system systems to be used, for example as depicted in FIGS. 15-19, FIGS. 20-24, FIGS. 30-34, FIGS. 35-39, and FIGS. 40-44, are configured, arranged, and oriented to be attachable to sight receiver 120 by using an appropriately configured base, such as depicted in those figures (e.g., bases 310, 410, 610, 710, and 810). In that way, the six rear sight system embodiments described in this disclosure may be used with the same sight receiver, such as sight receiver 120 configured in slide 100.

For various of those individual sighting system embodiments, it may preferable to use a different front sighting component, which may readily be accomplished by using the front sighting system depicted in FIGS. 9-14, either with the depicted sighting component 250 or with a sighting component having a base housing 255 compatible and complementary with front base 210 but having upper sighting structures configured, arranged and/or oriented for use as desired with the particular rear sighting component. For example, an embodiment with a fixed rear open sight will require a front sight blade with a height configured to achieve proper projectile point of impact at the selected range in which the projectile launching device is to be sighted-in. For further example, and operator may prefer to have a solid blade sight instead of a blade comprising an optical fiber, or may prefer a blade comprising the radio luminescent element for night sighting. These examples and many more readily may be configured, arranged, and oriented with a housing compatible with base 210, and thus be readily interchangeable without changing base 210 already attached in front sight receiver 110.

An individual sighting system may comprise plural sighting components attached, directly or indirectly, to the same base, for example as discussed above with respect to the embodiments of FIGS. 20-24, FIGS. 25-29, and FIGS. 40-44. Each of these exemplary embodiments comprises a reflex sight and an open iron sight, but other embodiments may comprise other combinations of sight types. For example, an embodiment may comprise an optic sight and an electronic sight. When deploying a sighting system comprising plural sighting component attached to the same base, it is preferred to cowitness those sights, so that projectile's point of impact at a selected range will be the same regardless of which sight is used. As an example with respect to the embodiment of FIGS. 20-24, the aiming indicator of reflex sight 450 will be adjusted to coincide with the projectile point of impact at a selected distance, and line of sight between notch 444 and optical fiber 271 (or the top of blade 270, as preferred by the operator) will be configured to coincide with that same projectile point of impact at the same distance. In this example, windage (i.e., lateral) adjustments to the point of impact may be made by moving sight body 442 laterally in dovetail slot 436, and elevation adjustments may be made by interchanging front sighting component 250 to have the necessary height of blade 270 (and thus the height of optical fiber 271). If this embodiment is part of a sighting system comprising plural individual sighting system, for example, the embodiments depicted in FIGS. 15-19, FIGS. 25-29, FIGS. 30-34, FIGS. 35-39, and/or FIGS. 40-44 and described above, point of impact and cowitnessing adjustments of iron sight components also may be accomplished by interchanging the front sight as needed or desired.

In many embodiments, for example as variously and exemplarily described above, interfitting structures form means to at least partially restrain or retain a base and a sight receiver, or a sighting component and a sight receiver, in longitudinal alignment and lateral alignment when assembled together, with such structures being longitudinally oriented. Some examples of such interfitting structures are described above, such as tenon 334 together with mortise 144, tenon 434 together with mortise 144, tenon 634 together with mortise 144, tenon 734 together with mortise 144, tenon 834 together with mortise 144, and the combination of upper cavity 260 and lower cavity 266 together with the combination of pedestal 220 and pedestal rim 230. In preferred embodiments, for example as depicted above, the interfitting parts extend longitudinally a substantial length of the respective base or sighting component and the sight receiver, preferably more than half of the longitudinal length of the interface between the base or sighting component and the sight receiver. By having the interfitting parts extend longitudinally a substantial length of the respective base or sighting component and the sight receiver, in various embodiments the stability of the longitudinal alignment and lateral alignment of the interfitting structures may be increased. In preferred embodiments, for example as depicted above, the interfitting parts comprise a single male structure and single female structure, such as the single tenons and single mortices of FIGS. 15-24B and 30-44B or the single pedestal composite structure and single cavity composite structure of FIGS. 9-14. In various embodiments, the use of unitary interfitting parts may provide greater strength and stability as well as easier manufacturing, compared to the use of multiple interfitting parts such as, for example, plural mortices with plural tenons or even a single mortice with plural tenons.

After appreciating this disclosure, those of skill in the art will recognize that the steps of the various methods, processes, and other techniques disclosed herein need not be performed in any particular order, unless otherwise expressly stated or logically necessary to satisfy expressly stated conditions. In addition, after appreciating this disclosure, those skilled in the art will recognize that other embodiments may have a variety of different forms of devices and systems, and that various changes, substitutions, and alterations may be made without departing from the spirit and scope of this disclosure. The described embodiments are illustrative only and are not restrictive, and the scope of this disclosure is defined solely by the following claims and any further claims in this application or any application claiming priority to this application.

The invention claimed is:

1. A sight system for a projectile launching device comprising:

a sight receiver comprising a first surface and a second surface meeting the first surface at an angle along a first intersection line, with the second surface comprising a recess having an upper edge; and a base comprising a third surface, a fourth surface meeting the third surface at an obtuse angle along a second intersection line, a protrusion extending from an end of the fourth surface distal from the second intersection line, with the protrusion comprising an upper surface, and an attachment point disposed on the third surface distal from the second intersection line;

the sight system having an assembled configuration in which:

the protrusion is inserted into the recess with the upper surface of the protrusion in contact with the upper edge of the recess, and with the second intersection line in contact with the first surface;

the upper edge of the recess applies a first downward force on the upper surface of the protrusion; and the base is attached to the sight receiver with a fastener exerting a second downward force on the base at the attachment point, such that the first downward force acting about the second intersection line imposes a moment on the base acting in a first direction, and the second downward force acting about the second intersection line imposes a moment on the base acting in a second direction.

2. The sight system of claim 1 in which the third surface is substantially planar and the fourth surface is substantially planar.

3. The sight system of claim 2 in which the base is elongated in a longitudinal direction, and the second intersection line is substantially orthogonal to the longitudinal direction.

4. The sight system of claim 2 in which the upper edge of the recess is disposed a first distance away from the first intersection line, and the upper surface of the protrusion extends from the end of the fourth surface at a point disposed in a plane parallel to and spaced away from the substantially planar third surface by a second distance that is greater than the first distance by a first difference.

* * * * *